US007277848B2

(12) United States Patent
Chen et al.

(10) Patent No.: US 7,277,848 B2
(45) Date of Patent: Oct. 2, 2007

(54) MEASURING AND USING RELIABILITY OF COMPLEXITY ESTIMATES DURING QUALITY AND RATE CONTROL FOR DIGITAL AUDIO

(75) Inventors: Wei-Ge Chen, Issaquah, WA (US); Naveen Thumpudi, Sammamish, WA (US); Ming-Chieh Lee, Bellevue, WA (US)

(73) Assignee: Microsoft Corporation, Redmond, WA (US)

( * ) Notice: Subject to any disclaimer, the term of this patent is extended or adjusted under 35 U.S.C. 154(b) by 273 days.

(21) Appl. No.: 11/066,859

(22) Filed: Feb. 24, 2005

(65) Prior Publication Data

US 2005/0177367 A1 Aug. 11, 2005

Related U.S. Application Data

(62) Division of application No. 10/017,694, filed on Dec. 14, 2001, now Pat. No. 7,027,982.

(51) Int. Cl.
*G10L 21/02* (2006.01)

(52) U.S. Cl. ..... 704/227; 375/240

(58) Field of Classification Search ..... None
See application file for complete search history.

(56) References Cited

U.S. PATENT DOCUMENTS

| | | | |
|---|---|---|---|
| 4,051,470 | A | 9/1977 | Esteban et al. |
| 4,454,546 | A | 6/1984 | Mori |
| 4,493,091 | A | 1/1985 | Gundry |
| 4,706,260 | A | 11/1987 | Fedele et al. |
| 4,802,224 | A | 1/1989 | Shiraki et al. |
| 4,954,892 | A | 9/1990 | Asai et al. |
| 5,043,919 | A | 8/1991 | Callaway et al. |
| 5,089,889 | A | 2/1992 | Sugiyama |
| 5,136,377 | A | 8/1992 | Johnston et al. |
| 5,235,618 | A | 8/1993 | Sakai et al. |
| 5,266,941 | A | 11/1993 | Akeley et al. |
| 5,317,672 | A | 5/1994 | Crossman et al. |
| 5,394,170 | A | 2/1995 | Akeley et al. |
| 5,398,069 | A | 3/1995 | Huang et al. |

(Continued)

OTHER PUBLICATIONS

Advanced Television Systems Committee, "ATSC Standard: Digital Audio Compression (AC-3), Revision A," pp. 1-140 (Aug. 2001).

(Continued)

*Primary Examiner*—Donald L. Storm
(74) *Attorney, Agent, or Firm*—Klarquist Sparkman, LLP

(57) ABSTRACT

An audio encoder regulates quality and bitrate with a control strategy. The strategy includes several features. First, an encoder regulates quantization using quality, minimum bit count, and maximum bit count parameters. Second, an encoder regulates quantization using a noise measure that indicates reliability of a complexity measure. Third, an encoder normalizes a control parameter value according to block size for a variable-size block. Fourth, an encoder uses a bit-count control loop de-linked from a quality control loop. Fifth, an encoder addresses non-monotonicity of quality measurement as a function of quantization level when selecting a quantization level. Sixth, an encoder uses particular interpolation rules to find a quantization level In a quality or bit-count control loop. Seventh, an encoder filters a control parameter value to smooth quality. Eighth, an encoder corrects model bias by adjusting a control parameter value in view of current buffer fullness.

28 Claims, 13 Drawing Sheets

U.S. PATENT DOCUMENTS 5,400,371 A * 3/1995 Natarajan ..... 375/240
5,414,796 A 5/1995 Jacobs et al.
5,448,297 A 9/1995 Alattar et al.
5,457,495 A 10/1995 Hartung
5,467,134 A 11/1995 Laney et al.
5,533,052 A 7/1996 Bhaskar
5,570,363 A 10/1996 Holm
5,579,430 A 11/1996 Grill et al.
5,586,200 A 12/1996 Devaney et al.
5,602,959 A 2/1997 Bergstrom et al.
5,623,424 A 4/1997 Azadegan et al.
5,650,860 A 7/1997 Uz
5,654,760 A 8/1997 Ohtsuki
5,661,755 A 8/1997 Van De Kerkhof et al.
5,666,161 A 9/1997 Kohiyama et al.
5,686,964 A 11/1997 Tabatabai et al.
5,724,453 A 3/1998 Ratnakar et al.
5,742,735 A 4/1998 Eberlein et al.
5,754,974 A 5/1998 Griffin et al.
5,787,203 A 7/1998 Lee et al.
5,802,213 A 9/1998 Gardos
5,819,215 A 10/1998 Dobson et al.
5,825,310 A 10/1998 Tsutsui
5,835,149 A 11/1998 Astle
5,845,243 A * 12/1998 Smart et al. ..... 704/200.1
5,867,230 A 2/1999 Wang et al.
5,884,039 A 3/1999 Ludwig et al.
5,886,276 A 3/1999 Levine et al.
5,926,226 A 7/1999 Proctor et al.
5,933,451 A 8/1999 Ozkan et al.
5,952,943 A 9/1999 Walsh et al.
5,982,305 A 11/1999 Taylor
5,986,712 A 11/1999 Peterson et al.
5,990,945 A 11/1999 Sinha et al.
5,995,151 A 11/1999 Naveen et al.
6,002,439 A 12/1999 Murakami et al.
6,029,126 A 2/2000 Malvar
6,049,630 A 4/2000 Wang et al.
6,058,362 A 5/2000 Malvar
6,072,831 A 6/2000 Chen
6,073,153 A 6/2000 Malvar
6,075,768 A 6/2000 Mishra
6,088,392 A 7/2000 Rosenberg
6,111,914 A 8/2000 Bist
6,115,689 A 9/2000 Malvar
6,160,846 A 12/2000 Chiang et al.
6,182,034 B1 1/2001 Malvar
6,212,232 B1 4/2001 Reed et al.
6,215,820 B1 4/2001 Bagni et al.
6,223,162 B1 4/2001 Chen et al.
6,226,407 B1 5/2001 Zabih et al.
6,240,380 B1 5/2001 Malvar
6,243,497 B1 6/2001 Chiang et al.
6,278,735 B1 8/2001 Mohsenian
6,320,825 B1 11/2001 Bruekers et al.
6,351,226 B1 2/2002 Saunders et al.
6,370,502 B1 4/2002 Wu et al.
6,421,738 B1 7/2002 Ratan et al.
6,421,739 B1 7/2002 Holiday
6,441,754 B1 8/2002 Wang et al.
6,473,409 B1 10/2002 Malvar
6,490,554 B2 12/2002 Endo et al.
6,501,798 B1 12/2002 Sivan
6,522,693 B1 2/2003 Lu et al.
6,539,124 B2 * 3/2003 Sethuraman et al. ..... 382/251
6,573,915 B1 6/2003 Sivan
6,574,593 B1 6/2003 Gao et al.
6,654,417 B1 11/2003 Hui
6,654,419 B1 11/2003 Sriram et al.
6,728,317 B1 4/2004 Demos
6,732,071 B2 5/2004 Lopez-Estrada et al.
6,760,598 B1 7/2004 Kurjenniemi
6,810,083 B2 10/2004 Chen et al.
6,876,703 B2 4/2005 Ismaeil et al.
6,895,050 B2 5/2005 Lee
6,934,677 B2 8/2005 Chen et al.
7,027,982 B2 4/2006 Chen et al.
7,143,030 B2 11/2006 Chen et al.
7,146,313 B2 12/2006 Chen et al.
2002/0143556 A1 10/2002 Kadatch
2002/0154693 A1 10/2002 Demos
2002/0176624 A1 11/2002 Kostrzewski et al.
2003/0110236 A1 6/2003 Yang et al.
2003/0115041 A1 6/2003 Chen
2003/0115042 A1 6/2003 Chen
2003/0115050 A1 6/2003 Chen
2003/0115051 A1 6/2003 Chen
2003/0115052 A1 6/2003 Chen
2003/0125932 A1 7/2003 Wang et al.
2005/0015528 A1 1/2005 Du
2005/0084166 A1 4/2005 Boneh et al.
2005/0135484 A1 6/2005 Lee
2005/0157784 A1 7/2005 Tanizawa et al.
2006/0062302 A1 3/2006 Yin et al.

OTHER PUBLICATIONS

Baron et al., "Coding the Audio Signal," *Digital Image and Audio Communications*, pp. 101-128, (1998).
Cheung et al., "A Comparison of Scalar Quantization Strategies for Noisy Data Channel Data Transmission," *IEEE Transactions on Communications*, vol. 43, No. 2/3/4, pp. 738-742 (Apr. 1995).
Crisafulli et al., "Adaptive Quantization: Solution via Nonadaptive Linear Control," *IEEE Transactions on Communications*, vol. 41, pp. 741-748 (May 1993).
Dalgic et al., "Characterization of Quality and Traffic for Various Video Encoding Schemes and Various Encoder Control Schemes," Technical Report No. CSL-TR-96-701 (Aug. 1996).
Gibson et al., "Quantization," Digital Compression for Multimedia, Chapter 4, pp. 113-138 (1998).
Gibson et al., "Frequency Domain Speech and Audio Coding Standards," Digital Compression for Multimedia, Chapter 8, pp. 263-290 (1998).
Gibson et al., "MPEG Audio," Digital Compression for Multimedia, Chapter 11.4, pp. 398-402 (1998).
Gibson et al., "More MPEG," Digital Compression for Multimedia, Chapter 11.6.2-11.6.4, pp. 415-416 (1998).
ISO/IEC 13818-7, "Information Technology-Generic Coding of Moving Pictures and Associated Audio Information," Part 7: Advanced Audio Coding (AAC), pp. i-iv, 1-145 (1997).
ISO/IEC 13818-7, Technical Corrigendum 1, "Information Technology-Generic Coding of Moving Pictures and Associated Audio Information," Part 7: Advanced Audio Coding (AAC), Technical Corrigendum, pp. 1-22 (1997).
ISO, "MPEG-4 Video Verification Model version 18.0," ISO/IEC JTC1/SC29/WG11 N3908, Pisa, pp. 1-10, 299-311 (Jan. 2001).
Jafarkhani, H., et al., "Entropy-Constrained Successively Refinable Scalar Quantization," *IEEE Data Compression Conference*, pp. 337-346 (1997).
Jayant et al., "Digital Codingof Waveforms, Principles and Applications to Speech and Video," Prentice Hall, pp. 428-445 (1984).
Naveen et al., "Subband Finite State Scalar Quantization," *IEEE Transactions on Image Processing*, vol. 5, No. 1, pp. 150-155 (Jan. 1996).
Ortega et al., "Optimal Buffer-Constrained Source Quantization and Fast Approximation," *IEEE*, pp. 192-195 (1992).
Ortega et al., "Adaptive Scalar Quantization Without Side Information," *IEEE Transactions on Image Processing*, vol. 6, No. 5, pp. 665-676 (May 1997).
Ramchandran et al., "Bit Allocation for Dependent Quantization with Applications to MPEG Video Coders," *IEEE*, pp. v-381-v-384 (1993).
Ratnakar et al., "RD-OPT: An Effieient Algorithm for Optimization DCT Quantization Tables," 11 pp.

Sidiropoulos, "Optimal Adaptive Scalar Quantization and Image Compression," *ICIP*, pp. 574-578, (1998).
Sullivan, "Optimal Entropy Constrained Scalar Quantization for Exponential and Laplacian Random Variables," *ICASSP*, pp. V-265-V-268 (1994).
Trushkin, "On the Design on an Optimal Quantizer," *IEEE Transactions on Information Theory*, vol. 39, No. 4, pp. 1180-1194 (Jul. 1993).
Westerink et al., "Two-pass MPEG-2 Varialbe-bit-rate Encoding," *IBM J. Res. Develop.*, vol. 43, No. 4, pp. 471-488 (1999).
Wong, "Progressively Adaptive Scalar Quantization," *ICIP*, pp. 357-360, (1996).
Wu et al., "Entropy-Constrined Scalar Quantization and Minimum Entropy with Error Bound by Discrete Wavelet Transforms in Image Compression," *IEEE Transactions on Image Processing*, vol. 48, No. 4, pp. 1133-1143 (Apr. 2000).
Wu et al., "Quantizer Monotonicities and Globally Optimally Scalar Quantizer Design," *IEEE Transactions on Information Theory*, vol. 39, No. 3, pp. 1049-1053 (May 1993).
Gibson et al., *Digital Compression for Multimedia*, Title Page, Contents, "Chapter 7: Frequency Domain Coding," Morgan Kaufman Publishers, Inc., pp. iii, v-xi, and 227-262 (1998).
H.S. Malvar, *Signal Processing with Lapped Transforms*, Artech House, Norwood, MA, pp. iv, vii-xi, 175-218, and 353-357 (1992).
H.S. Malvar, "Lapped Transforms for Efficient Transform/Subband Coding," *IEEE Transactions on Acoustics, Speech and Signal Processing*, vol. 38, No. 6, pp. 969-978 (1990).
Seymour Schlien, "The Modulated Lapped Transform, Its Time-Varying Forms, and Its Application to Audio Coding Standards," *IEEE Transactions on Speech and Audio Processing*, vol. 5, No. 4, pp. 359-366 (Jul. 1997).
de Queiroz et al., "Time-Varying Lapped Transforms and Wavelet Packets," *IEEE Transactions on Signal Processing*, vol. 41, pp. 3293-3305 (1993).
Herley et al., "Tilings of the Time-Frequency Plane: Construction of Arbitrary Orthogonal Bases and Fast Tiling Algorithms," *IEEE Transactions on Signal Processing*, vol. 41, No. 12, pp. 3341-3359 (1993).
ISO/IEC 11172-3, Information Technology—Coding of Moving Pictures and Associated Audio for Digital Storage Media at Up to About 1.5 Mbit/s—Part 3: Audio, 154 pp. (1993).
Dolby Laboratories, "AAC Technology," 4 pp. [Downloaded from the web site aac-audio.com on World Wide Web on Nov. 21, 2001.]
Srinivasan et al., "High-Quality Audio Compression Using an Adaptive Wavelet Packet Decomposition and Psychoacoustic Modeling," *IEEE Transactions on Signal Processing*, vol. 46, No. 4, pp. 1085-1093 (Apr. 1998).
Caetano et al., "Rate Control Strategy for Embedded Wavelet Video Coders," *Electronics Letters*, pp. 1818-1817 (Oct. 14, 1999).
Ribas Corbera et al., "Rate Control in DCT Video Coding for Low-Delay Communications," *IEEE Transactions on Circuits and Systems for Video Technology*, vol. 9, No. 1, pp. 172-185 (Feb. 1999).
Zwicker et al., *Das Ohr als Nachrichtenempfänger*, Title Page, Table of Contents, "I: Schallschwingungen," Index, Hirzel-Verlag, Stuttgart, pp. III, IX-XI, 1-26, and 231-232 (1967).
Terhardt, "Calculating Virtual Pitch," *Hearing Research*, 1:155-182 (1979).
Lufti, "Additivity of Simultaneous Masking," *Journal of Acoustic Society of America*, 73:262-267 (1983).
Jesteadt et al., "Forward Masking as a Function of Frequency, Masker Level, and Signal Delay," *Journal of Acoustical Society of America*, 71:950-962 (1982).
ITU, Recommendation ITU-R BS 1387, Method for Objective Measurements of Perceived Audio Quality, 89 pp. (1998).
ITU, Recommendation ITU-R BS 1115, Low Bit-Rate Audio Coding, 9 pp. (1994).
Beerends, "Audio Quality Determination Based on Perceptual Measurement Techniques," *Applications of Digital Signal Processing to Audio and Acoustics*, Chapter 1, Ed. Mark Kahrs, Karlheinz Brandenburg, Kluwer Acad. Publ., pp. 1-38 (1998).
Zwicker, *Psychoakustik*, Title Page, Table of Contents, "Teil I: Einfuhrung," Index, Springer-Verlag, Berlin Heidelberg, New York, pp. II, IX-XI, 1-30, and 157-162 (1982).
Solari, *Digital Video and Audio Compression*, Title Page, Contents, "Chapter 8: Sound and Audio," McGraw-Hill, Inc., pp. iii, v-vi, and 187-211 (1997).
A.M. Kondoz, *Digital Speech: Coding for Low Bit Rate Communications Systems*, "Chapter 3.3: Linear Predictive Modeling of Speech Signals" and "Chapter 4: LPC Parameter Quantisation Using LSFs," John Wiley & Sons, pp. 42-53 and 79-97 (1994).
Wragg et al., "An Optimised Software Solution for an ARM Powered™ MP3 Decoder," 9 pp. [Downloaded from the World Wide Web on Oct. 27, 2001.]
Fraunhofer-Gesellschaft, "MPEG Audio Layer3-," 4 pp. [Downloaded from the World Wide Web on Oct. 24, 2001.]
Fraunhofer-Gesellschaft, "MPEG-2 AAC," 3 pp. [Downloaded from the World Wide Web on Oct. 24, 2001.]
OPTICOM GmbH, "Objective Perceptual Measurement," 14 pp. [Downloaded from the World Wide Web on Oct. 24, 2001.]
De Luca, "AN1090 Application Note: STA013 MPEG 2.5 Layer III Source Decoder," STMicroelectronics, 17 pp. (1999).
Phamdo, "Speech Compression," 13 pp. [Downloaded from the World Wide Web on Nov. 25, 2001.]
Malvar, "Biorthogonal and Nonuniform Lapped Transforms for Transform Coding with Reduced Blocking and Ringing Artifacts," appeared in *IEEE Transactions on Signal Processing, Special Issue on Multirate Systems, Filter Banks, Wavelets, and Applications*, vol. 46, 29 pp. (1998).
Li et al., "Optimal Linear Interpolation Coding for Server-Based Computing," *Proc. IEEE Int'l Conf. on Communications*, 5 pp. (2002).
Ronda et al., "Rate Control and Bit Allocation for MPEG-4," *IEEE Transactions on Circuits and Systems for Video Technology*, pp. 1243-1258 (1999).
Schaar-Mitrea et al., "Hybrid Compression of Video wtih Graphics in DTV Communicaiton Systems," *IEEE Trans. on Consumer Electronics*, pp. 1007-1017 (2000).
Vetro et al., "An Overview of MPEG-4 Object-Based Encoeding Algorithms," *IEEE International Symposium on Information Technology*, pp. 366-369 (2001).
"DivX Multi Standard Video Encoder," 2 pp. (Downloaded from the World Wide Web on Jan. 24, 2006).
Gill et al., "Creating High-Quality Content with Microsoft Windows Media Encoder 7," 4 pp. (2000). [Downloaded from the World Wide Web on May 1, 2002.].
Schuster et al., "A Theory for the Optimal Bit Allocation Between Displacement Vector Field and Displaced Frame Difference," *IEEE J. on Selected Areas in Comm.*, vol. 15, No. 9, pp. 1739-1751 (Dec. 1997).
Sullivan et al., "Rate-Distortion Optimization for Video Compression,"*IEEE Signal Processing Magazaine*, pp. 74-70 (Nov. 1998).
Tao et al., "Adaptive Model-driven Bit Allocation for MPEG Video Coding," *IEEE Transactions on Circuits and Systems for Video Tech.*, vol. 10, No. 1, pp. 147-157 (Feb. 2000).
Tsang et al., "Fuzzy based rate control for real-time MPEG video," 12 pp.
Yang et al., "Rate Control for Videophone Using Local Perceptual Cues," *IEEE Transactions on Circuits and Systems for Video Tech.*, vol. 15, No. 4, pp. 496-507 (Apr. 2005).
Reed et al., "Constrained Bit-Rate Control for Very Low Bit-Rate Streaming-Video Applications," *IEEE Transactions on Circuits and Systems for Video Technology*, vol. 11, No. 7, pp. 882-889 (Jul. 2001).
Sheu et al., "A Buffer Allocation Mechanism for VBR Video Playback," Communication Tech. Proc. 2000, WCC-ICCT 2000, vol. 2, pp. 1641-1644 (2000).
Walpole et al., "A Player for Adaptive MPEG Video Streaming over the Internet," Proc. SPIE, vol. 3240, pp. 270-281 (1998).

* cited by examiner

Figure 1

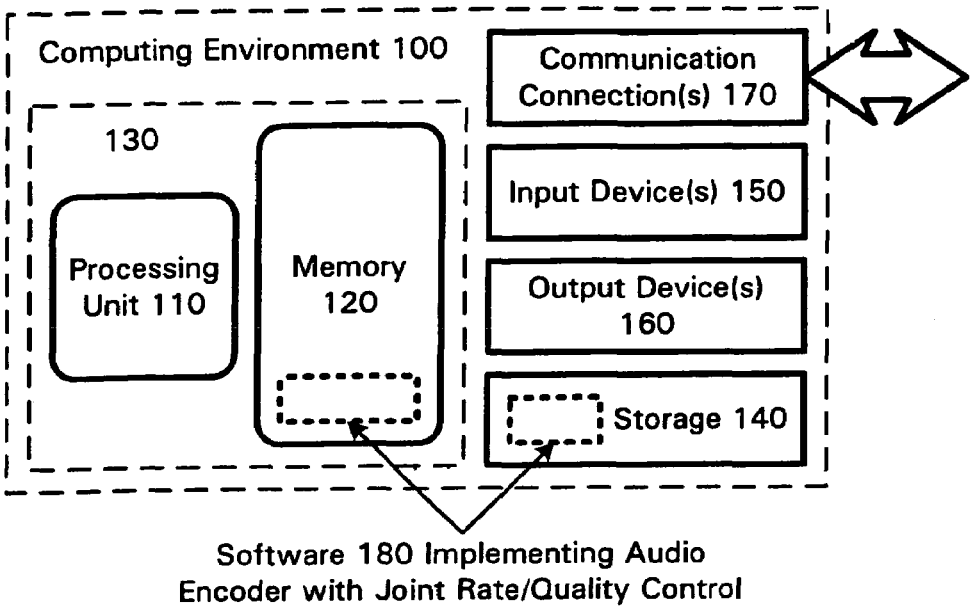

Figure 7a $$f_3(B_F, B_{FSP}) = \begin{cases} 0.8 & 0.95 < B_F \\ 0.8 & 0.9 < B_F \le 0.95 \\ 0.75 & 0.85 < B_F \le 0.9 \\ 0.7 & 0.8 < B_F \le 0.85 \\ 0.65 & 0.75 < B_F \le 0.8 \\ 0.6 & 0.7 < B_F \le 0.75 \\ 0.55 & 0.65 < B_F \le 0.7 \\ 0.45 & 0.6 < B_F \le 0.65 \\ 0.45 & 0.55 < B_F \le 0.6 \\ 0.45 & 0.5 < B_F \le 0.55 \\ 0.5 & 0.4 < B_F \le 0.5 \\ 0.5 & 0.3 < B_F \le 0.4 \\ 0.4 & 0.2 < B_F \le 0.3 \\ 0.4 & 0.1 < B_F \le 0.2 \\ 0.4 & B_F \le 0.1 \end{cases}$$

Figure 7b $$f_3(B_F, B_{FSP}) = \begin{cases} 0.8 & 0.95 < B_F \\ 0.8 & 0.9 < B_F \le 0.95 \\ 0.75 & 0.85 < B_F \le 0.9 \\ 0.7 & 0.8 < B_F \le 0.85 \\ 0.65 & 0.75 < B_F \le 0.8 \\ 0.65 & 0.7 < B_F \le 0.75 \\ 0.65 & 0.65 < B_F \le 0.7 \\ 0.65 & 0.6 < B_F \le 0.65 \\ 0.65 & 0.55 < B_F \le 0.6 \\ 0.6 & 0.5 < B_F \le 0.55 \\ 0.55 & 0.4 < B_F \le 0.5 \\ 0.5 & 0.3 < B_F \le 0.4 \\ 0.4 & 0.2 < B_F \le 0.3 \\ 0.4 & 0.1 < B_F \le 0.2 \\ 0.4 & B_F \le 0.1 \end{cases}$$

Figure 5a $$f_1(B_F, B_{FSP}, N_c, N_{Max}) = \begin{cases} 10 & B_F \le 0.1 \\ 8 & 0.1 < B_F \le 0.2 \\ 6 & 0.2 < B_F \le 0.3 \\ 6 & 0.3 < B_F \le 0.7 \,\&\&\, N_c \ne N_{Max} \\ 3.5 & 0.3 < B_F \le 0.7 \,\&\&\, N_c = N_{Max} \\ 4.0 & 0.7 < B_F \,\&\&\, N_c \ne N_{Max} \\ 2.25 & 0.7 < B_F \,\&\&\, N_c = N_{Max} \end{cases}$$

Figure 6

$$f_2(B_F, B_{FSP}, N_c, N_{Max}) = \begin{cases} 0.35 & B_F \le 0.65 \,\&\&\, 2 \cdot N_c \ge N_{Max} \\ 0.25 & 0.65 < B_F \,\&\&\, 2 \cdot N_c \ge N_{Max} \\ 0.55 & B_F \le 0.65 \,\&\&\, 8 \cdot N_c \ge N_{Max} \\ 0.45 & 0.65 < B_F \,\&\&\, 8 \cdot N_c \ge N_{Max} \\ 0.85 & B_F \le 0.65 \,\&\&\, 16 \cdot N_c \ge N_{Max} \\ 0.65 & 0.65 < B_F \,\&\&\, 16 \cdot N_c \ge N_{Max} \end{cases}$$

Figure 5b $$f_1(B_F, B_{FSP}, N_c, N_{Max}) = \begin{cases} 10 & B_F \le 0.1 \\ 8 & 0.1 < B_F \le 0.2 \\ 6 & 0.2 < B_F \le 0.3 \\ 4 & 0.3 < B_F \le 0.7 \,\&\&\, N_c \ne N_{Max} \\ 2.25 & 0.3 < B_F \le 0.7 \,\&\&\, N_c = N_{Max} \\ 2.0 & 0.7 < B_F \,\&\&\, N_c \ne N_{Max} \\ 1.25 & 0.7 < B_F \,\&\&\, N_c = N_{Max} \end{cases}$$

Figure 8a $$f_4(B_F, B_{FSP}) = \begin{cases} 6 & 0.95 < B_F \\ 10 & 0.9 < B_F \le 0.95 \\ 15 & 0.85 < B_F \le 0.9 \\ 25 & 0.8 < B_F \le 0.85 \\ 30 & 0.75 < B_F \le 0.8 \\ 40 & 0.7 < B_F \le 0.75 \\ 50 & 0.65 < B_F \le 0.7 \\ 60 & 0.6 < B_F \le 0.65 \\ 60 & 0.55 < B_F \le 0.6 \\ 60 & 0.5 < B_F \le 0.55 \\ 30 & 0.4 < B_F \le 0.5 \\ 30 & 0.3 < B_F \le 0.4 \\ 18 & 0.2 < B_F \le 0.3 \\ 18 & 0.1 < B_F \le 0.2 \\ 18 & B_F \le 0.1 \end{cases}$$

Figure 8b $$f_4(B_F, B_{FSP}) = \begin{cases} 6 & 0.95 < B_F \\ 6 & 0.9 < B_F \le 0.95 \\ 15 & 0.85 < B_F \le 0.9 \\ 15 & 0.8 < B_F \le 0.85 \\ 30 & 0.75 < B_F \le 0.8 \\ 30 & 0.7 < B_F \le 0.75 \\ 30 & 0.65 < B_F \le 0.7 \\ 60 & 0.6 < B_F \le 0.65 \\ 40 & 0.55 < B_F \le 0.6 \\ 20 & 0.5 < B_F \le 0.55 \\ 20 & 0.4 < B_F \le 0.5 \\ 20 & 0.3 < B_F \le 0.4 \\ 18 & 0.2 < B_F \le 0.3 \\ 18 & 0.1 < B_F \le 0.2 \\ 18 & B_F \le 0.1 \end{cases}$$

Figure 16

$$bias_correction = \max((0.75 \cdot b_{Header}), (0.0625 \cdot b_{Achieved}))$$

$$f_5(\ldots) = \begin{cases} -bias_correction & ((B_{FSP} \le 0.5) \,\&\&\, (B_F < 0.4)) \,\|\, ((B_{FSP} > 0.5) \,\&\&\, (B_F < 0.55)) \\ bias_correction & ((B_{FSP} \le 0.5) \,\&\&\, (B_F > 0.6)) \,\|\, ((B_{FSP} > 0.5) \,\&\&\, (B_F > 0.75)) \\ 0 & otherwise \end{cases}$$

MEASURING AND USING RELIABILITY OF COMPLEXITY ESTIMATES DURING QUALITY AND RATE CONTROL FOR DIGITAL AUDIO

RELATED APPLICATION INFORMATION

The present application is a divisional of U.S. patent application Ser. No. 10/017,694, filed Dec. 14, 2001, entitled "Quality and Rate Control Strategy For Digital Audio," now U.S. Pat. No. 7,027,982, the disclosure of which is hereby incorporated by reference. The following U.S. patent applications relate to the present application: 1) U.S. patent application Ser. No. 10/020,708, entitled, "Adaptive Window-Size Selection in Transform Coding," filed Dec. 14, 2001, the disclosure of which is hereby incorporated by reference; 2) U.S. patent application Ser. No. 10/016,918, entitled, "Quality Improvement Techniques in an Audio Encoder," filed Dec. 14, 2001, now U.S. Pat. No. 7,240,001, the disclosure of which is hereby incorporated by reference; 3) U.S. patent application Ser. No. 10/017,702, entitled, "Quantization Matrices Based on Critical Band Pattern Information for Digital Audio Wherein Ouantization Bands Differ from Critical Bands," filed Dec. 14, 2001, now U.S. Pat. No. 6,934,677, the disclosure of which is hereby incorporated by reference; and 4) U.S. patent application Ser. No. 10/017,861, entitled, "Techniques for Measurement of Perceptual Audio Quality," filed Dec. 14, 2001, now U.S. Pat. No. 7,146,313, the disclosure of which is hereby incorporated by reference.

TECHNICAL FIELD

The present invention relates to a quality and rate control strategy for digital audio. In one embodiment, an audio encoder controls quality and bitrate by adjusting quantization of audio information.

BACKGROUND

With the introduction of compact disks, digital wireless telephone networks, and audio delivery over the Internet, digital audio has become commonplace. Engineers use a variety of techniques to control the quality and bitrate of digital audio. To understand these techniques, it helps to understand how audio information is represented in a computer and how humans perceive audio.

I. Representation of Audio Information in a Computer

A computer processes audio information as a series of numbers representing the audio information. For example, a single number can represent an audio sample, which is an amplitude (i.e., loudness) at a particular time. Several factors affect the quality of the audio information, including sample depth, sampling rate, and channel mode.

Sample depth (or precision) indicates the range of numbers used to represent a sample. The more values possible for the sample, the higher the quality because the number can capture more subtle variations in amplitude. For example, an 8-bit sample has 256 possible values, while a 16-bit sample has 65,536 possible values.

The sampling rate (usually measured as the number of samples per second) also affects quality. The higher the sampling rate, the higher the quality because more frequencies of sound can be represented. Some common sampling rates are 8,000, 11,025, 22,050, 32,000, 44,100, 48,000, and 96,000 samples/second.

Mono and stereo are two common channel modes for audio. In mono mode, audio information is present in one channel. In stereo mode, audio information is present in two channels usually labeled the left and right channels. Other modes with more channels, such as 5-channel surround sound, are also possible. Table 1 shows several formats of audio with different quality levels, along with corresponding raw bitrate costs.

TABLE 1

Bitrates for different quality audio information

| Quality | Sample Depth (bits/sample) | Sampling Rate (samples/second) | Mode | Raw Bitrate (bits/second) |
|---|---|---|---|---|
| Internet telephony | 8 | 8,000 | mono | 64,000 |
| telephone | 8 | 11,025 | mono | 88,200 |
| CD audio | 16 | 44,100 | stereo | 1,411,200 |
| high quality audio | 16 | 48,000 | stereo | 1,536,000 |

As Table 1 shows, the cost of high quality audio information such as CD audio is high bitrate. High quality audio information consumes large amounts of computer storage and transmission capacity.

Compression (also called encoding or coding) decreases the cost of storing and transmitting audio information by converting the information into a lower bitrate form. Compression can be lossless (in which quality does not suffer) or lossy (in which quality suffers). Decompression (also called decoding) extracts a reconstructed version of the original information from the compressed form.

Quantization is a conventional lossy compression technique. There are many different kinds of quantization including uniform and non-uniform quantization, scalar and vector quantization, and adaptive and non-adaptive quantization. Quantization maps ranges of input values to single values. For example, with uniform, scalar quantization by a factor of 3.0, a sample with a value anywhere between −1.5 and 1.499 is mapped to 0, a sample with a value anywhere between 1.5 and 4.499 is mapped to 1, etc. To reconstruct the sample, the quantized value is multiplied by the quantization factor, but the reconstruction is imprecise. Continuing the example started above, the quantized value 1 reconstructs to $1\times3=3$; it is impossible to determine where the original sample value was in the range 1.5 to 4.499. Quantization causes a loss in fidelity of the reconstructed value compared to the original value. Quantization can dramatically improve the effectiveness of subsequent lossless compression, however, thereby reducing bitrate.

An audio encoder can use various techniques to provide the best possible quality for a given bitrate, including transform coding, modeling human perception of audio, and rate control. As a result of these techniques, an audio signal can be more heavily quantized at selected frequencies or times to decrease bitrate, yet the increased quantization will not significantly degrade perceived quality for a listener.

Transform coding techniques convert information into a form that makes it easier to separate perceptually important information from perceptually unimportant information. The less important information can then be quantized heavily, while the more important information is preserved, so as to provide the best perceived quality for a given bitrate. Transform coding techniques typically convert information into the frequency (or spectral) domain. For example, a transform coder converts a time series of audio samples into frequency coefficients. Transform coding techniques include Discrete Cosine Transform ["DCT"], Modulated Lapped Transform ["MLT"], and Fast Fourier Transform ["FFT"]. In practice, the input to a transform coder is partitioned into blocks, and each block is transform coded. Blocks may have varying or fixed sizes, and may or may not overlap with an adjacent block. After transform coding, a frequency range of coefficients may be grouped for the purpose of quantization, in which case each coefficient is quantized like the others in the group, and the frequency range is called a quantization band. For more information about transform coding and MLT in particular, see Gibson et al., *Digital Compression for Multimedia*, "Chapter 7: Frequency Domain Coding," Morgan Kaufman Publishers, Inc., pp. 227-262 (1998); U.S. Pat. No. 6,115,689 to Malvar; H. S. Malvar, *Signal Processing with Lapped Transforms*, Artech House, Norwood, Mass., 1992; or Seymour Schlein, "The Modulated Lapped Transform, Its Time-Varying Forms, and Its Application to Audio Coding Standards," IEEE Transactions on Speech and Audio Processing, Vol. 5, No. 4, pp. 359-66, July 1997.

In addition to the factors that determine objective audio quality, perceived audio quality also depends on how the human body processes audio information. For this reason, audio processing tools often process audio information according to an auditory model of human perception.

Typically, an auditory model considers the range of human hearing and critical bands. Humans can hear sounds ranging from roughly 20 Hz to 20 kHz, and are most sensitive to sounds in the 2-4 kHz range. The human nervous system integrates sub-ranges of frequencies. For this reason, an auditory model may organize and process audio information by critical bands. Aside from range and critical bands, interactions between audio signals can dramatically affect perception. An audio signal that is clearly audible if presented alone can be completely inaudible in the presence of another audio signal, called the masker or the masking signal. The human ear is relatively insensitive to distortion or other loss in fidelity (i.e., noise) in the masked signal, so the masked signal can include more distortion without degrading perceived audio quality. An auditory model typically incorporates other factors relating to physical or neural aspects of human perception of sound.

Using an auditory model, an audio encoder can determine which parts of an audio signal can be heavily quantized without introducing audible distortion, and which parts should be quantized lightly or not at all. Thus, the encoder can spread distortion across the signal so as to decrease the audibility of the distortion.

II. Controlling Rate and Quality of Audio Information

Different audio applications have different quality and bitrate requirements. Certain applications require constant quality over time for compressed audio information. Other applications require variable quality and bitrate. Still other applications require constant or relatively constant bitrate [collectively, "constant: bitrate" or "CBR"]. One such CBR application is encoding audio for streaming over the Internet.

A CBR encoder outputs compressed audio information at a constant bitrate despite changes in the complexity of the audio information. Complex audio information is typically less compressible than simple audio information. For the CBR encoder to meet bitrate requirements, the CBR encoder can adjust how the audio information is quantized. The quality of the compressed audio information then varies, with lower quality for periods of complex audio information due to increased quantization and higher quality for periods of simple audio information due to decreased quantization.

While adjustment of quantization and audio quality is necessary at times to satisfy constant bitrate requirements, current CBR encoders can cause unnecessary changes in quality, which can result in thrashing between high quality and low quality around the appropriate, middle quality. Moreover, when changes in audio quality are necessary, current CBR encoders often cause abrupt changes, which are more noticeable and objectionable than smooth changes.

Microsoft Corporation's Windows Media Audio version 7.0 ["WMA7"] includes an audio encoder that can be used to compress audio information for streaming at a constant bitrate. The WMA7 encoder uses a virtual buffer and rate control to handle variations in bitrate due to changes in the complexity of audio information.

To handle short-term fluctuations around the constant bitrate (such as those due to brief variations in complexity), the WMA7 encoder uses a virtual buffer that stores some duration of compressed audio information. For example, the virtual buffer stores compressed audio information for 5 seconds of audio playback. The virtual buffer outputs the compressed audio information at the constant bitrate, so long as the virtual buffer does not underflow or overflow. Using the virtual buffer, the encoder can compress audio information at relatively constant quality despite variations in complexity, so long as the virtual buffer is long enough to smooth out the variations. In practice, virtual buffers must be limited in duration in order to limit system delay, however, and buffer underflow or overflow can occur unless the encoder intervenes.

To handle longer-term deviations from the constant bitrate (such as those due to extended periods of complexity or silence), the WMA7 encoder adjusts the quantization step size of a uniform, scalar quantizer in a rate control loop. The relation between quantization step size and bitrate is complex and hard to predict in advance, so the encoder tries one or more different quantization step sizes until the encoder finds one that results in compressed audio information with a bitrate sufficiently close to a target bitrate. The encoder sets the target bitrate to reach a desired buffer fullness, preventing buffer underflow and overflow. Based upon the complexity of the audio information, the encoder can also allocate additional bits for a block or deallocate bits when setting the target bitrate for the rate control loop.

The WMA7 encoder measures the quality of the reconstructed audio information for certain operations (e.g., deciding which bands to truncate). The WMA7 encoder does not use the quality measurement in conjunction with adjustment of the quantization step size in a quantization loop, however.

The WMA7 encoder controls bitrate and provides good quality for a given bitrate, but can cause unnecessary quality changes. Moreover, with the WMA7 encoder, necessary changes in audio quality are not as smooth as they could be in transitions from one level of quality to another.

Numerous other audio encoders use rate control strategies; for example, see U.S. Pat. No. 5,845,243 to Smart et al. Such rate control strategies potentially consider information other than or in addition to current buffer fullness, for example, the complexity of the audio information.

Several international standards describe audio encoders that incorporate distortion and rate control. The Motion Picture Experts Group, Audio Layer 3 ["MP3"] and Motion Picture Experts Group 2, Advanced Audio Coding ["AAC"] standards each describe techniques for controlling distortion and bitrate of compressed audio information.

In MP3, the encoder uses nested quantization loops to control distortion and bitrate for a block of audio information called a granule. Within an outer quantization loop for controlling distortion, the MP3 encoder calls an inner quantization loop for controlling bitrate.

In the outer quantization loop, the MP3 encoder compares distortions for scale factor bands to allowed distortion thresholds for the scale factor bands. A scale factor band is a range of frequency coefficients for which the encoder calculates a weight called a scale factor. Each scale factor starts with a minimum weight for a scale factor band. After an iteration of the inner quantization loop, the encoder amplifies the scale factors until the distortion in each scale factor band is less than the allowed distortion threshold for that scale factor band, with the encoder calling the inner quantization loop for each set of scale factors. In special cases, the encoder exits the outer quantization loop even if distortion exceeds the allowed distortion threshold for a scale factor band (e.g., if all scale factors have been amplified or if a scale factor has reached a maximum amplification).

In the inner quantization loop, the MP3 encoder finds a satisfactory quantization step size for a given set of scale factors. The encoder starts with a quantization step size expected to yield more than the number of available bits for the granule. The encoder then gradually increases the quantization step size until it finds one that yields fewer than the number of available bits.

The MP3 encoder calculates the number of available bits for the granule based upon the average number of bits per granule, the number of bits in a bit reservoir, and an estimate of complexity of the granule called perceptual entropy. The bit reservoir counts unused bits from previous granules. If a granule uses less than the number of available bits, the MP3 encoder adds the unused bits to the bit reservoir. When the bit reservoir gets too full, the MP3 encoder preemptively allocates more bits to granules or adds padding bits to the compressed audio information. The MP3 encoder uses a psychoacoustic model to calculate the perceptual entropy of the granule based upon the energy, distortion thresholds, and widths for frequency ranges called threshold calculation partitions. Based upon the perceptual entropy, the encoder can allocate more than the average number of bits to a granule.

For additional information about MP3 and AAC, see the MP3 standard ("ISO/IEC 11172-3, Information Technology—Coding of Moving Pictures and Associated Audio for Digital Storage Media at Up to About 1.5 Mbit/s—Part 3: Audio") and the AAC standard.

Although MP3 encoding has achieved widespread adoption, it is unsuitable for some applications (for example, real-time audio streaming at very low to mid bitrates) for several reasons. First, the nested quantization loops can be too time-consuming. Second, the nested quantization loops are designed for high quality applications, and do not work as well for lower bitrates which require the introduction of some audible distortion. Third, the MP3 control strategy assumes predictable rate-distortion characteristics in the audio (in which distortion decreases with the number of bits allocated), and does not address situations in which distortion increases with the number of bits allocated.

Other audio encoders use a combination of filtering and zero tree coding to jointly control quality and bitrate. An audio encoder decomposes an audio signal into bands at different frequencies and temporal resolutions. The encoder formats band information such that information for less perceptually important bands can be incrementally removed from a bitstream, if necessary, while preserving the most information possible for a given bitrate. For more information about zero tree coding, see Srinivasan et al., "High-Quality Audio Compression Using an Adaptive Wavelet Packet Decomposition and Psychoacoustic Modeling," IEEE Transactions on Signal Processing, Vol. 46, No. 4, pp. (April 1998).

While this strategy works for high quality, high complexity applications, it does not work as well for very low to mid-bitrate applications. Moreover, the strategy assumes predictable rate-distortion characteristics in the audio, and does not address situations in which distortion increases with the number of bits allocated.

Outside of the field of audio encoding, various joint quality and bitrate control strategies for video encoding have been published. For example, see U.S. Pat. No. 5,686,964 to Naveen et al.; U.S. Pat. No. 5,995,151 to Naveen et al.; Caetano et al., "Rate Control Strategy for Embedded Wavelet Video Coders," IEEE Electronics Letters, pp 1815-17 (Oct. 14, 1999); and Ribas-Corbera et al., "Rate Control in DCT Video Coding for Low-Delay Communications," IEEE Trans Circuits and Systems for Video Technology, Vol. 9, No 1, (February 1999).

As one might expect given the importance of quality and rate control to encoder performance, the fields of quality and rate control for audio and video applications are well developed. Whatever the advantages of previous quality and rate control strategies, however, they do not offer the performance advantages of the present invention.

SUMMARY

The present invention relates to a strategy for jointly controlling the quality and bitrate of audio information. The control strategy regulates the bitrate of audio information while also reducing quality changes and smoothing quality changes over time. The joint quality and bitrate control strategy includes various techniques and tools, which can be used in combination or independently.

According to a first aspect of the control strategy, quantization of audio information in an audio encoder is based at least in part upon values of a target quality parameter, a target minimum-bits parameter, and a target maximum-bits parameter. For example, the target minimum- and maximum-bits parameters define a range of acceptable numbers of produced bits within which the audio encoder has freedom to satisfy the target quality parameter.

According to a second aspect of the control strategy, an audio encoder regulates quantization of audio information based at least in part upon the value of a complexity estimate reliability measure. For example, the complexity estimate reliability measure indicates how much weight the audio encoder should give to a measure of past or future complexity when regulating quantization of the audio information.

According to a third aspect of the control strategy, an audio encoder normalizes according to block size when computing the value of a control parameter for a variable-size block. For example, the audio encoder multiplies the value by the ratio of the maximum block size to the current block size, which provides continuity in the values for the control parameter from block to block despite changes in block size.

According to a fourth aspect of the control strategy, an audio encoder adjusts quantization of audio information using a bitrate control quantization loop following and outside of a quality control quantization loop. The de-linked quantization loops help the encoder quickly adjust quantization in view of quality and bitrate goals. For example, the audio encoder finds a quantization step size that satisfies quality criteria in the quality control loop. The audio encoder then finds a quantization step size that satisfies bitrate criteria in the bit-count control loop, starting the testing with the step size found in the quality control loop.

According to a fifth aspect of the control strategy, an audio encoder selects a quantization level (e.g., a quantization step size) in a way that accounts for non-monotonicity of quality measure as a function of quantization level. This helps the encoder avoid selection of inferior quantization levels.

According to a sixth aspect of the control strategy, an audio encoder uses interpolation rules for a quantization control loop or bit-count control loop to find a quantization level in the loop. The particular interpolation rules help the encoder quickly find a satisfactory quantization level.

According to a seventh aspect of the control strategy, an audio encoder filters a value of a control parameter. For example, the audio encoder lowpass filters the value as part of a sequence of previously computed values for the control parameter, which smoothes the sequence of values, thereby smoothing quality in the encoder.

According to a eighth aspect of the control strategy, an audio encoder corrects bias in a model by adjusting the value of a control parameter based at least in part upon current buffer fullness. This can help the audio encoder compensate for systematic mismatches between the model and this audio information being compressed.

Additional features and advantages of the invention will be made apparent from the following detailed description of an illustrative embodiment that proceeds with reference to the accompanying drawings.

BRIEF DESCRIPTION OF THE DRAWINGS

FIG. 1 is a block diagram of a suitable computing environment in which the illustrative embodiment may be implemented.

FIGS. 5*a* and 5*b* are tables showing a non-linear function used in computing a value for a target maximum-bits parameter according to the illustrative embodiment.

FIG. 6 is a table showing a non-linear function used in computing a value for a target minimum-bits parameter according to the illustrative embodiment.

FIGS. 7*a* and 7*b* are tables showing a non-linear function used in computing a value for a desired buffer fullness parameter according to the illustrative embodiment.

FIGS. 8*a* and 8*b* are tables showing a non-linear function used in computing a value for a desired transition time parameter according to the illustrative embodiment.

FIG. 16 is a table showing a non-linear function used in computing a value for a bias-corrected bit-count parameter according to the illustrative embodiment.

DETAILED DESCRIPTION

Figure 2:
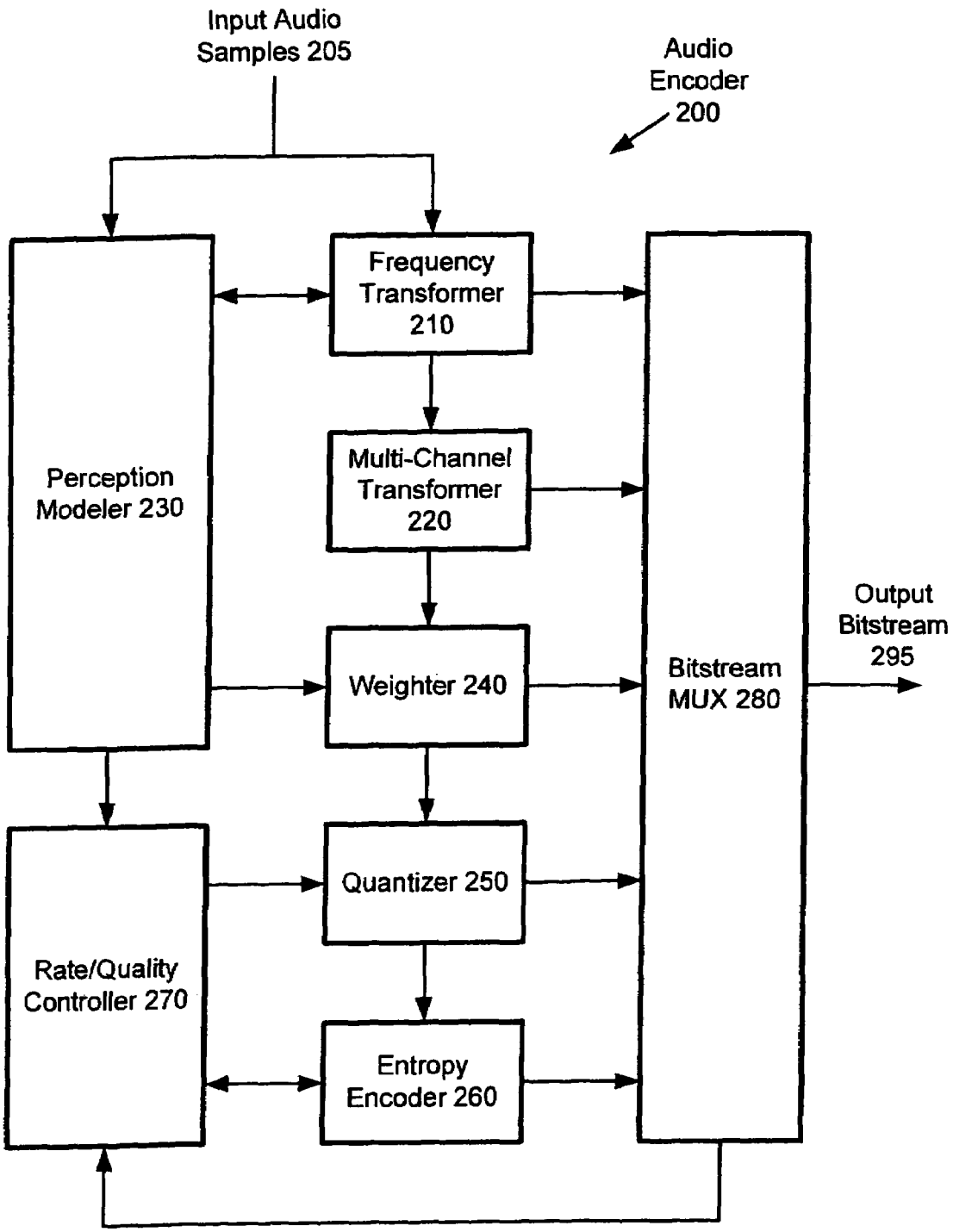
FIG. 2 is a block diagram of a generalized audio encoder according to the illustrative embodiment.

The illustrative embodiment of the present invention is directed to an audio encoder that jointly controls the quality and bitrate of audio information. The audio encoder adjusts quantization of the audio information to satisfy constant or relatively constant bitrate [collectively, "constant bitrate"] requirements, while reducing unnecessary variations in quality and ensuring that any necessary variations in quality are smooth over time.

The audio encoder uses several techniques to control the quality and bitrate of audio information. While the techniques are typically described herein as part of a single, integrated system, the techniques can be applied separately in quality and/or rate control, potentially in combination with other rate control strategies.

In the illustrative embodiment, an audio encoder implements the various techniques of the joint quality and rate control strategy. In alternative embodiments, another type of audio processing tool implements one or more of the techniques to control the quality and/or bitrate of audio information.

The illustrative embodiment relates to a quality and bitrate control strategy for audio compression. In alternative embodiments, a video encoder applies one or more of the control strategy techniques to control the quality and bitrate of video information

I. Computing Environment

FIG. 1 illustrates a generalized example of a suitable computing environment (100) in which the illustrative embodiment may be implemented. The computing environment (100) is not intended to suggest any limitation as to scope of use or functionality of the invention, as the present invention may be implemented in diverse general-purpose or special-purpose computing environments.

With reference to FIG. 1, the computing environment (100) includes at least one processing unit (110) and memory (120). In FIG. 1, this most basic configuration (130) is included within a dashed line. The processing unit (110) executes computer-executable instructions and may be a real or a virtual processor. In a multi-processing system, multiple processing units execute computer-executable instructions to increase processing power. The memory (120) may be volatile memory (e.g., registers, cache, RAM), non-volatile memory (e.g., ROM, EEPROM, flash memory, etc.), or some combination of the two. The memory (120) stores software (180) implementing an audio encoder with joint rate/quality control.

A computing environment may have additional features. For example, the computing environment (100) includes storage (140), one or more input devices (150), one or more output devices (160), and one or more communication connections (170). An interconnection mechanism (not shown) such as a bus, controller, or network interconnects the components of the computing environment (100). Typically, operating system software (not shown) provides an operating environment for other software executing in the computing environment (100), and coordinates activities of the components of the computing environment (100).

The storage (140) may be removable or non-removable, and includes magnetic disks, magnetic tapes or cassettes, CD-ROMs, CD-RWs, DVDs, or any other medium which can be used to store information and which can be accessed within the computing environment (100). The storage (140) stores instructions for the software (180) implementing the audio encoder with joint rate/quality control.

The input device(s) (150) may be a touch input device such as a keyboard, mouse, pen, or trackball, a voice input device, a scanning device, or another device that provides input to the computing environment (100). For audio, the input device(s) (150) may be a sound card or similar device that accepts audio input in analog or digital form, or a CD-ROM or CD-RW that provides audio samples to the computing environment. The output device(s) (160) may be a display, printer, speaker, CD-writer, or another device that provides output from the computing environment (100).

The communication connection(s) (170) enable communication over a communication medium to another computing entity. The communication medium conveys information such as computer-executable instructions, compressed audio or video information, or other data in a modulated data signal. A modulated data signal is a signal that has one or more of its characteristics set or changed in such a manner as to encode information in the signal. By way of example, and not limitation, communication media include wired or wireless techniques implemented with an electrical, optical, RF, infrared, acoustic, or other carrier.

The invention can be described in the general context of computer-readable media. Computer-readable media are any available media that can be accessed within a computing environment. By way of example, and not limitation, with the computing environment (100), computer-readable media include memory (120), storage (140), communication media, and combinations of any of the above.

The invention can be described in the general context of computer-executable instructions, such as those included in program modules, being executed in a computing environment on a target real or virtual processor. Generally, program modules include routines, programs, libraries, objects, classes, components, data structures, etc. that perform particular tasks or implement particular abstract data types. The functionality of the program modules may be combined or split between program modules as desired in various embodiments. Computer-executable instructions for program modules may be executed within a local or distributed computing environment.

For the sake of presentation, the detailed description uses terms like "determine," "generate," "adjust," and "apply" to describe computer operations in a computing environment. These terms are high-level abstractions for operations performed by a computer, and should not be confused with acts performed by a human being. The actual computer operations corresponding to these terms vary depending on implementation.

II. Generalized Audio Encoder and Decoder

Figure 3:
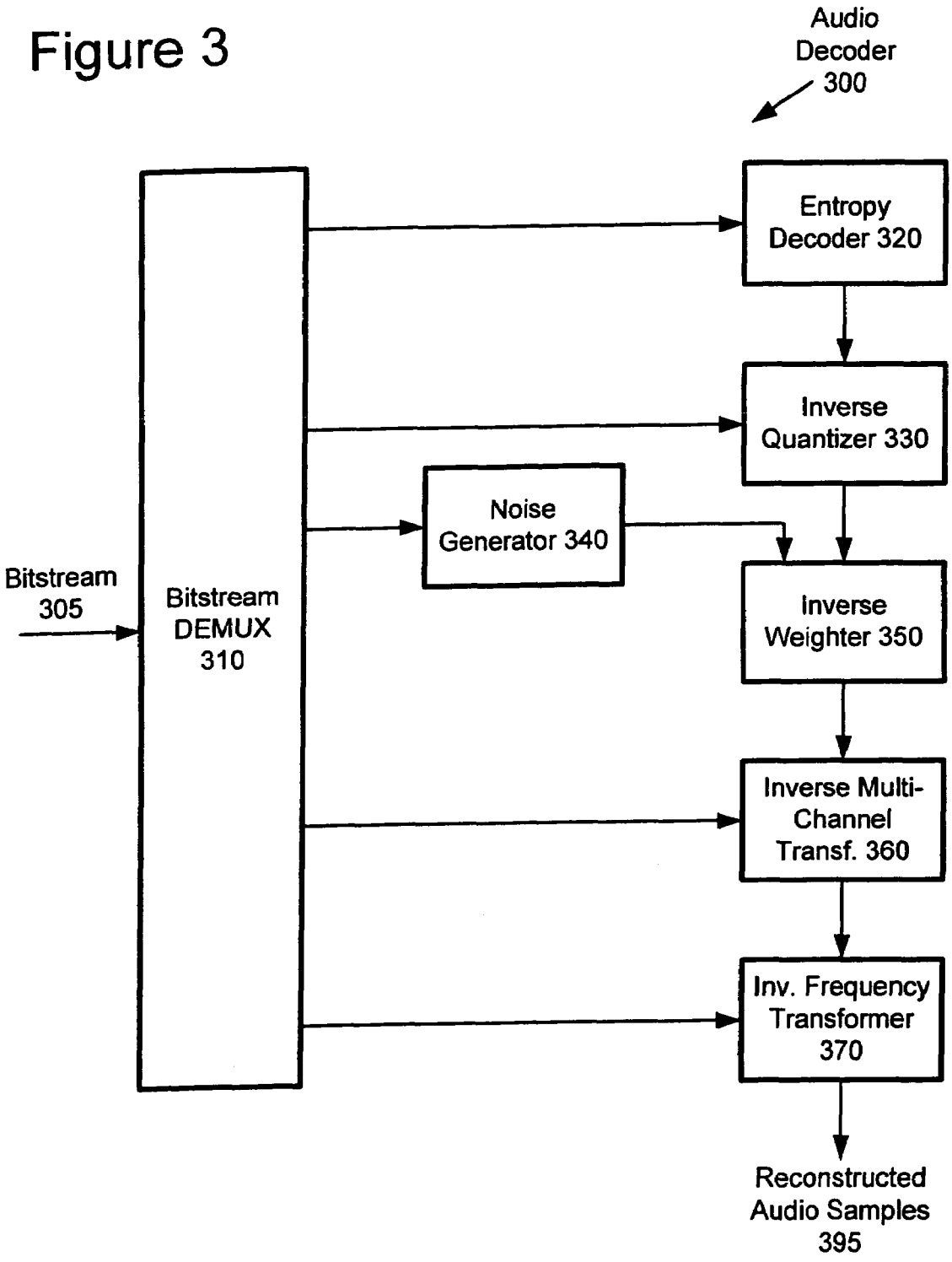
FIG. 3 is a block diagram of a generalized audio decoder according to the illustrative embodiment.

FIG. 2 is a block diagram of a generalized audio encoder (200). The encoder (200) adaptively adjusts quantization of an audio signal based upon quality and bitrate constraints. This helps ensure that variations in quality are smooth over time while maintaining constant bitrate output. FIG. 3 is a block diagram of a generalized audio decoder (300).

The relationships shown between modules within the encoder and decoder indicate the main flow of information in the encoder and decoder; other relationships are not shown for the sake of simplicity. Depending on implementation and the type of compression desired, modules of the encoder or decoder can be added, omitted, split into multiple modules, combined with other modules, and/or replaced with like modules. In alternative embodiments, an encoder with different modules and/or other configurations of modules control quality and bitrate of compressed audio information.

A. Generalized Audio Encoder

The generalized audio encoder (200) includes a frequency transformer (210), a multi-channel transformer (220), a perception modeler (230), a weighter (240), a quantizer (250), an entropy encoder (260), a rate/quality controller (270), and a bitstream multiplexer ["MUX"] (280).

The encoder (200) receives a time series of input audio samples (205) in a format such as one shown in Table 1. For input with multiple channels (e.g., stereo mode), the encoder (200) processes channels independently, and can work with jointly coded channels following the multi-channel transformer (220). The encoder (200) compresses the audio samples (205) and multiplexes information produced by the various modules of the encoder (200) to output a bitstream (295) in a format such as Windows Media Audio ["WMA"] or Advanced Streaming Format ["ASF"]. Alternatively, the encoder (200) works with other input and/or output formats.

The frequency transformer (210) receives the audio samples (205) and converts them into information in the frequency domain. The frequency transformer (210) splits the audio samples (205) into blocks, which can have variable size to allow variable temporal resolution. Small blocks allow for greater preservation of time detail at short but active transition segments in the input audio samples (205), but sacrifice some frequency resolution. In contrast, large blocks have better frequency resolution and worse time resolution, and usually allow for greater compression efficiency at longer and less active segments, in part because frame header and side information is proportionally less than in small blocks. Blocks can overlap to reduce perceptible discontinuities between blocks that could otherwise be introduced by later quantization. The frequency transformer (210) outputs blocks of frequency coefficients to the multi-channel transformer (220) and outputs side information such as block sizes to the MUX (280). The frequency transformer (210) outputs both the frequency coefficients and the side information to the perception modeler (230).

In the illustrative embodiment, the frequency transformer (210) partitions a frame of audio input samples (305) into overlapping sub-frame blocks with time-varying size and applies a time-varying MLT to the sub-frame blocks. Possible sub-frame sizes include 256, 512, 1024, 2048, and 4096 samples. The MLT operates like a DCT modulated by a time window function, where the window function is time varying and depends on the sequence of sub-frame sizes. The MLT transforms a given overlapping block of samples $x[n], 0 \leqq n < subframe_size$ into a block of frequency coefficients $X[k], 0 \leqq k < subframe_size/2$. The frequency transformer (210) also outputs estimates of the transient strengths of samples in the current and future frames to the rate/quality controller (270). Alternative embodiments use other varieties of MLT. In still other alternative embodiments, the frequency transformer (210) applies a DCT, FFT, or other type of modulated or non-modulated, overlapped or non-overlapped frequency transform, or use subband or wavelet coding.

For multi-channel audio, the multiple channels of frequency coefficients produced by the frequency transformer (210) often correlate. To exploit this correlation, the multi-channel transformer (220) can convert the multiple original, independently coded channels into jointly coded channels. For example, if the input is stereo mode, the multi-channel transformer (220) can convert the left and right channels into sum and difference channels:

$$X_{Sum}[k] = \frac{X_{Left}[k] + X_{Right}[k]}{2}, \tag{1}$$

$$X_{Diff}[k] = \frac{X_{Left}[k] - X_{Right}[k]}{2}. \tag{2}$$

Or, the multi-channel transformer (220) can pass the left and right channels through as independently coded channels. More generally, for a number of input channels greater than one, the multi-channel transformer (220) passes original, independently coded channels through unchanged or converts the original channels into jointly coded channels. The decision to use independently or jointly coded channels can be predetermined, or the decision can be made adaptively on a block by block or other basis during encoding. The multi-channel transformer (220) produces side information to the MUX (280) indicating the channel mode used.

The perception modeler (230) models properties of the human auditory system to improve the quality of the reconstructed audio signal for a given bitrate. The perception modeler (230) computes the excitation pattern of a variable-size block of frequency coefficients. First, the perception modeler (230) normalizes the size and amplitude scale of the block. This enables subsequent temporal smearing and establishes a consistent scale for quality measures. Optionally, the perception modeler (230) attenuates the coefficients at certain frequencies to model the outer/middle ear transfer function. The perception modeler (230) computes the energy of the coefficients in the block and aggregates the energies by, for example, 25 critical bands. Alternatively, the perception modeler (230) uses another number of critical bands (e.g., 55 or 109). The frequency ranges for the critical bands are implementation-dependent, and numerous options are well known. For example, see ITU, Recommendation IU-R BS 1387, Method for Objective Measurements of Perceived Audio Quality, 1998, the MP3 standard, or references mentioned therein. The perception modeler (230) processes the band energies to account for simultaneous and temporal masking. In alternative embodiments, the perception modeler (230) processes the audio information according to a different auditory model, such as one described or mentioned in ITU-R BS 1387 or the MP3 standard.

The weighter (240) generates weighting factors for a quantization matrix based upon the excitation pattern received from the perception modeler (230) and applies the weighting factors to the information received from the multi-channel transformer (220). The weighting factors include a weight for each of multiple quantization bands in the audio information. The quantization bands can be the same or different in number or position from the critical bands used elsewhere in the encoder (200). The weighting factors indicate proportions at which noise is spread across the quantization bands, with the goal of minimizing the audibility of the noise by putting more noise in bands where it is less audible, and vice versa. The weighting factors can vary in amplitudes and number of quantization bands from block to block. In one implementation, the number of quantization bands varies according to block size; smaller blocks have fewer quantization bands than larger blocks. For example, blocks with 128 coefficients have 13 quantization bands, blocks with 256 coefficients have 15 quantization bands, up to 25 quantization bands for blocks with 2048 coefficients. In one implementation, the weighter (240) generates a set of weighting factors for each channel of multi-channel audio in independently coded channels, or generates a single set of weighting factors for jointly coded channels. In alternative embodiments, the weighter (240) generates the weighting factors from information other than or in addition to excitation patterns. Instead of applying the weighting factors, the weighter (240) can pass the weighting factors to the quantizer (250) for application in the quantizer (250).

The weighter (240) outputs weighted blocks of coefficients to the quantizer (250) and outputs side information such as the set of weighting factors to the MUX (280). The weighter (240) can also output the weighting factors to the rate/quality controller (270) or other modules in the encoder (200). The set of weighting factors can be compressed for more efficient representation. If the weighting factors are lossy compressed, the reconstructed weighting factors are typically used to weight the blocks of coefficients. If audio information in a band of a block is completely eliminated for some reason (e.g., noise substitution or band truncation), the encoder (200) may be able to further improve the compression of the quantization matrix for the block.

The quantizer (250) quantizes the output of the weighter (240), producing quantized coefficients to the entropy encoder (260) and side information including quantization step size to the MUX (280). Quantization introduces irreversible loss of information, but also allows the encoder (200) to regulate the quality and bitrate of the output bitstream (295) in conjunction with the rate/quality controller (270), as described below. In FIG. 2, the quantizer (250) is an adaptive, uniform, scalar quantizer. The quantizer (250) applies the same quantization step size to each frequency coefficient, but the quantization step size itself can change from one iteration of a quantization loop to the next to affect the bitrate of the entropy encoder (260) output. In alternative embodiments, the quantizer is a non-uniform quantizer, a vector quantizer, and/or a non-adaptive quantizer.

The entropy encoder (260) losslessly compresses quantized coefficients received from the quantizer (250). For example, the entropy encoder (260) uses multi-level run length coding, variable-to-variable length coding, run length coding, Huffman coding, dictionary coding, arithmetic coding, LZ coding, a combination of the above, or some other entropy encoding technique. The entropy encoder (260) can compute the number of bits spent encoding audio information and pass this information to the rate/quality controller (270).

The rate/quality controller (270) works with the quantizer (250) to regulate the bitrate and quality of the output of the encoder (200). The rate/quality controller (270) receives information from other modules of the encoder (200). As described below, in one implementation, the rate/quality controller (270) receives 1) transient strengths from the frequency transformer (210), 2) sampling rate, block size information, and the excitation pattern of original audio information from the perception modeler (230), 3) weighting factors from the weighter (240), 4) a block of quantized audio information in some form (e.g., quantized, reconstructed), 5) bit count information for the block; and 6) buffer status information from the MUX (280). The rate/quality controller (270) can include an inverse quantizer, an inverse weighter, an inverse multi-channel transformer, and potentially other modules to reconstruct the audio information or compute information about the block.

The rate/quality controller (270) processes the received information to determine a desired quantization step size given current conditions. The rate/quality controller (270) outputs the quantization step size to the quantizer (250). The rate/quality controller (270) measures the quality of a block of reconstructed audio information as quantized with the quantization step size. Using the measured quality as well as bitrate information, the rate/quality controller (270) adjusts the quantization step size with the goal of satisfying bitrate and quality constraints, both instantaneous and long-term. For example, for a streaming audio application, the rate/quality controller (270) sets the quantization step size for a block such that 1) virtual buffer underflow and overflow are avoided, 2) bitrate over a certain period is relatively constant, and 3) any necessary changes to quality are smooth. In alternative embodiments, the rate/quality controller (270) works with different or additional information, or applies different techniques to regulate quality and/or bitrate.

The encoder (200) can apply noise substitution, band truncation, and/or multi-channel rematrixing to a block of audio information. At low and mid-bitrates, the audio encoder (200) can use noise substitution to convey information in certain bands. In band truncation, if the measured quality for a block indicates poor quality, the encoder (200) can completely eliminate the coefficients in certain (usually higher frequency) bands to improve the overall quality in the remaining bands. In multi-channel rematrixing, for low bitrate, multi-channel audio in jointly coded channels, the encoder (200) can suppress information in certain channels (e.g., the difference channel) to improve the quality of the remaining channel(s) (e.g., the sum channel).

The MUX (280) multiplexes the side information received from the other modules of the audio encoder (200) along with the entropy encoded information received from the entropy encoder (260). The MUX (280) outputs the information in WMA format or another format that an audio decoder recognizes.

The MUX (280) includes a virtual buffer that stores the bitstream (295) to be output by the encoder (200). The virtual buffer stores a pre-determined duration of audio information (e.g., 5 seconds for streaming audio) in order to smooth over short-term fluctuations in bitrate due to complexity changes in the audio. The virtual buffer then outputs data at a constant bitrate. The current fullness of the buffer, the rate of change of fullness of the buffer, and other characteristics of the buffer can be used by the rate/quality controller (270) to regulate quality and/or bitrate.

B. Generalized Audio Decoder

With reference to FIG. 3, the generalized audio decoder (300) includes a bitstream demultiplexer ["DEMUX"] (310), an entropy decoder (320), an inverse quantizer (330), a noise generator (340), an inverse weighter (350), an inverse multi-channel transformer (360), and an inverse frequency transformer (370). The decoder (300) is simpler than the encoder (200) because the decoder (300) does not include modules for rate/quality control.

The decoder (300) receives a bitstream (305) of compressed audio information in WMA format or another format. The bitstream (305) includes entropy encoded information as well as side information from which the decoder (300) reconstructs audio samples (395). For audio information with multiple channels, the decoder (300) processes each channel independently, and can work with jointly coded channels, before the inverse multi-channel transformer (360).

The DEMUX (310) parses information in the bitstream (305) and sends information to the modules of the decoder (300). The DEMUX (310) includes one or more buffers to compensate for short-term variations in bitrate due to fluctuations in complexity of the audio, network jitter, and/or other factors.

The entropy decoder (320) losslessly decompresses entropy codes received from the DEMUX (310), producing quantized frequency coefficients. The entropy decoder (320) typically applies the inverse of the entropy encoding technique used in the encoder.

The inverse quantizer (330) receives a quantization step size from the DEMUX (310) and receives quantized frequency coefficients from the entropy decoder (320). The inverse quantizer (330) applies the quantization step size to the quantized frequency coefficients to partially reconstruct the frequency coefficients. In alternative embodiments, the inverse quantizer applies the inverse of some other quantization technique used in the encoder.

From the DEMUX (310), the noise generator (340) receives information indicating which bands in a block are noise substituted as well as any parameters for the form of the noise. The noise generator (340) generates the patterns for the indicated bands, and passes the information to the inverse weighter (350).

The inverse weighter (350) receives the weighting factors from the DEMUX (310), patterns for any noise-substituted bands from the noise generator (340), and the partially reconstructed frequency coefficients from the inverse quantizer (330). As necessary, the inverse weighter (350) decompresses the weighting factors. The inverse weighter (350) applies the weighting factors to the partially reconstructed frequency coefficients for bands that have not been noise substituted. The inverse weighter (350) then adds in the noise patterns received from the noise generator (340) for the noise-substituted bands.

The inverse multi-channel transformer (360) receives the reconstructed frequency coefficients from the inverse weighter (350) and channel mode information from the DEMUX (310). If multi-channel audio is in independently coded channels, the inverse multi-channel transformer (360) passes the channels through. If multi-channel audio is in jointly coded channels, the inverse multi-channel transformer (360) converts the audio into independently coded channels.

The inverse frequency transformer (370) receives the frequency coefficients output by the multi-channel transformer (360) as well as side information such as block sizes from the DEMUX (310). The inverse frequency transformer (370) applies the inverse of the frequency transform used in the encoder and outputs blocks of reconstructed audio samples (395).

III. Jointly Controlling Quality and Bitrate of Audio Information

According to the illustrative embodiment, an audio encoder produces a compressed bitstream of audio information for streaming over a network at a constant bitrate. By controlling both the quality of the reconstructed audio information and the bitrate of the compressed audio information, the audio encoder reduces unnecessary quality changes and ensures that any necessary quality changes are smooth as the encoder satisfies the constant bitrate requirement For example, when the encoder encounters a prolonged period of complex audio information, the encoder may need to decrease quality. At such times, the encoder smoothes the transition between qualities to make such transitions less objectionable and noticeable.

Figure 4:
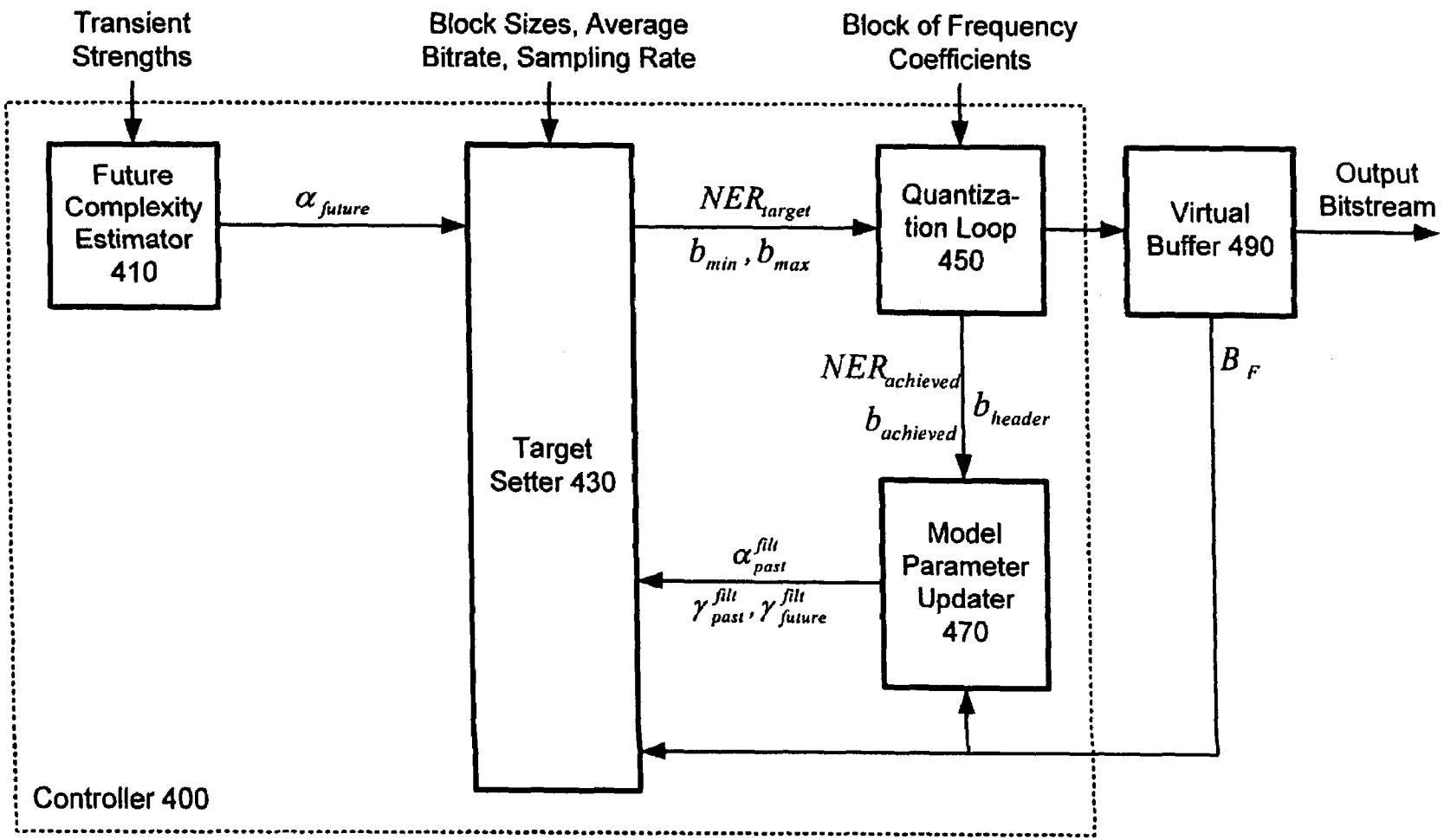
FIG. 4 is a block diagram of a joint rate/quality controller according to the illustrative embodiment.

FIG. 4 shows a joint rate/quality controller (400). The controller (400) can be realized within the audio encoder (200) shown in FIG. 2 or, alternatively, within another audio encoder The joint rate/quality controller (400) includes a future complexity estimator (410), a target setter (430), a quantization loop (450), and a model parameter updater (470). FIG. 4 shows the main flow of information into, out of, and within the controller (400); other relationships are not shown for the sake of simplicity. Depending on implementation, modules of the controller (400) can be added, omitted, split into multiple modules, combined with other modules, and/or replaced with like modules. In alternative embodiments, a controller with different modules and/or other configurations of modules controls quality and/or bitrate using one or more of the following techniques.

The controller (400) receives information about the audio signal, a current block of audio information, past blocks, and future blocks. Using this information, the controller (400) sets a quality target and determines bitrate requirements for the current block. The controller (400) regulates quantization of the current block with the goal of satisfying the quality target and the bitrate requirements. The bitrate requirements incorporate fullness constraints of the virtual buffer (490), which are necessary to make the compressed audio information streamable at a constant bitrate.

With reference to FIG. 4, a summary of each of the modules of the controller (400) follows. The details of each of the modules of the controller (400) are described below.

Several modules of the controller (400) compute or use a complexity measure which roughly indicates the coding complexity for a block, frame, or other window of audio information. In some modules, complexity relates to the strengths of transients in the signal. In other modules, complexity is the product of the bits produced by coding a block and the quality achieved for the block, normalized to the largest block size. In general, modules of the controller (400) compute complexity based upon available information, and can use formulas for complexity other than or in addition to the ones mentioned above.

Several modules of the controller (400) compute or use a quality measure for a block that indicates the perceptual quality for the block. Typically, the quality measure is expressed in terms of Noise-to-Excitation Ratio ["NER"]. In some modules, actual NER values are computed from noise patterns and excitation patterns for blocks. In other modules, suitable NER values for blocks are estimated based upon complexity, bitrate, and other factors. For additional detail about NER, see the related U.S. patent application entitled, "Techniques for Measurement of Perceptual Audio Quality," referenced above. In general, modules of the controller (400) compute quality measures based upon available information, and can use techniques other than NER to measure objective or perceptual quality, for example, a technique described or mentioned in ITU-R BS 1387.

The future complexity estimator (410) receives information about transient positions and strengths for the current frame as well as a few future frames. The future complexity estimator (410) estimates the complexity of the current and future frames, and provides a complexity estimates $\alpha_{future}$ to the target setter (430).

The target setter (430) sets bit-count and quality targets. In addition to the future complexity estimate, the target setter (430) receives information about the size of the current block, maximum block size, sampling rate for the audio signal, and average bitrate for the compressed audio information. From the model parameter updater (470), the target setter (430) receives a complexity estimate $\alpha_{past}^{filt}$ for past blocks and noise measures $\gamma_{past}^{filt}$ and $\gamma_{future}^{filt}$ for the past and future complexity estimates. From the virtual buffer (490), the target setter (430) receives a measure of current buffer fullness $B_F$. From all of this information, the target setter (430) computes minimum-bits $b_{min}$ and maximum-bits $b_{max}$ for the block as well as a target quality in terms of target NER ["$NER_{target}$"] for the block. The target setter (430) sends the parameters $b_{min}$, $b_{max}$, and $NER_{target}$ for the block to the quantization loop (450).

The quantization loop (450) tries different quantization step sizes to achieve the quality then bit-count targets. Modules of the quantization loop (450) receive the current block of audio information, apply the weighting factors to the current block (if the weighting factors have not already been applied), and iteratively select a quantization step size and apply it to the current block. After the quantization loop (450) finds a satisfactory quantization step size for the quality and bit-count targets, the quantization loop (450) outputs the total number of bits $b_{achieved}$, header bits $b_{header}$, and achieved quality (in terms of NER) $NER_{achieved}$ for the current block. To the virtual buffer (490), the quantization loop (450) outputs the compressed audio information for the current block.

Using the parameters received from the quantization loop (450) and the measure of current buffer fullness $B_F$, the model parameter updater (470) updates the past complexity estimate $\alpha_{past}^{filt}$ and the noise measures $\gamma_{past}^{filt}$ and $\gamma_{future}^{filt}$ for the past and future complexity estimates. The target setter (430) uses the updated parameters when generating bit-count and quality targets for the next block of audio information to be compressed.

The virtual buffer (490) stores compressed audio information for streaming at a constant bitrate, so long as the virtual buffer neither underflows nor overflows. The virtual buffer (490) smoothes out local variations in bitrate due to fluctuations in the complexity/compressibility of the audio signal. This lets the encoder allocate more bits to more complex portions of the signal and allocate less bits to less complex portions of the signal, which reduces variations in quality over time while still providing output at the constant bitrate. The virtual buffer (490) provides information such as current buffer fullness $B_F$ to modules of the controller (400), which can then use the information to regulate quantization within quality and bitrate constraints.

A. Future Complexity Estimator

The future complexity estimator (410) estimates the complexities of the current and future frames in order to determine how many bits the encoder can responsibly spend encoding the current block. In general, if future audio information is complex, the encoder allocates fewer bits to the current block with increased quantization, saving the bits for the future. Conversely, if future audio information is simple, the encoder borrows bits from the future to get better quality for the current block with decreased quantization.

The most direct way to determine the complexity of the current and future audio information is to encode the audio information. The controller (400) typically lacks the computational resources to encode for this purpose, however, so the future complexity estimator (410) uses an indirect mechanism to estimate the complexity of the current and future audio information. The number of future frames for which the future complexity estimator (410) estimates complexity is flexible (e.g., 4, 8, 16), and can be pre-determined or adaptively adjusted.

A transient detection module analyzes incoming audio samples of the current and future frames to detect transients. The transients represent sudden changes in the audio signal, which the encoder typically encodes using blocks of smaller size for better temporal resolution. The transient detection module also determines the strengths of the transients.

In one implementation, the transient detection module is outside of the controller (400) and associated with a frequency transformer that adaptively uses time-varying block sizes. The transient detection module bandpass filters a frame of audio samples into one or more bands (e.g., low, middle, and high bands). The module squares the filtered values to determine power outputs of the bands. From the power output of each band, the module computes at each sample 1) a lowpass-filtered power output of the band and 2) a local power output (in a smaller window than the lowpass filter) at each sample for the bands. For each sample, the module then calculates in each band the ratio between the local power output and the lowpass-filtered power output. For a sample, if the ratio in any band exceeds the threshold for that band, the module marks the sample as a transient. For additional detail about the transient detection module of this implementation, see the related U.S. patent application entitled, "Adaptive Window-Size Selection in Transform Coding," referenced above. Alternatively, the transient detection module is within the future complexity estimator (410).

The transient detection module computes the transient strength for each sample or only for samples marked as transients. The module can compute transient strength for a sample as the average of the ratios for the bands for the sample, the sum of the ratios, the maximum of the ratios, or some other linear or non-linear combination of the ratios. To compute transient strength for a frame, the module takes the average of the computed transient strengths for the samples of the frame or the samples following the current block in the frame. Or, the module can take the sum of the computed transient strengths, or some other linear or non-linear combination of the computed transient strengths. Rather than the module, the future complexity estimator (410) can compute transient strengths for frames from the transient strength information for samples.

From the transient strength information for the current and future frames, the future complexity estimator (410) computes a composite strength:

$$TS = \sum_{Current,FutureFrames} \frac{TransientStrength[Frame] - \mu}{\sigma}, \quad (3)$$

$$CompositeStrength = e^{TS}, \quad (4)$$

where TransientStrength[Frame] is an array of the transient strengths for frames, and where μ and σ are implementation-dependent normalizing constants derived experimentally. In one implementation, μ is 0 and σ is the number of current and future frames in the summation (or the number of frames times the number of channels, if the controller (400) is processing multiple channels).

The future complexity estimator (410) next maps the composite strength to a complexity estimate using a control parameter $B_{filt}$ received from the target parameter updater (470).

$$\alpha_{future} = \beta_{filt} \cdot \text{CompositeStrength} \quad (5).$$

Based upon the actual results of recent encoding, the control parameter $\beta_{filt}$ indicates the historical relationship between complexity estimates and composite strengths. Extrapolating from this historical relationship to the present, the future complexity estimator (410) maps the composite strength of the current and future frames to a complexity estimate $\alpha_{future}$. The target parameter updater (470) updates $\beta_{filt}$ on a block-by-block basis, as described below.

In alternative embodiments, (he future complexity estimator (410) uses a direct technique (i.e., actual encoding, and complexity equals the product of achieved bits and achieved quality) or a different indirect technique to determine the complexity of samples to be coded in the future, potentially using parameters other than or in addition to the parameters given above. For example, the future complexity estimator (410) uses transient strengths of windows of samples other than frames, uses a measure other than transient strength, or computes composite strength using a different formula (e.g., $2e^{TS}$ instead of $e^{TS}$, different TS).

B. Target Setter

The target setter (430) sets target quality and bit-count parameters for the controller (400). By using a target quality, the controller (400) reduces quality variation from block to block, while still staying within the bit-count parameters for the block. In one implementation, the target setter (430) computes a target quality parameter, a target minimum-bits parameter, and a target maximum-bits parameter. Alternatively, the target setter (430) computes target parameters other than or in addition to these parameters.

The target setter (430) computes the target quality and bit-count parameters from a variety of other control parameters. For some control parameters, the target setter (430) normalizes values for the control parameters according to current block size. This provides continuity in the values for the control parameters despite changes in transform block size.

1. Target Bit-count Parameters

The target setter (430) sets a target minimum-bits parameter and a target maximum-bits parameter for the current block. The target minimum-bits parameter helps avoid underflow of the virtual buffer (490) and also guards against deficiencies in quality measurement, particularly at low bitrates. The target maximum-bits parameter prevents overflow of the virtual buffer (490) and also constrains the number of bits the controller (400) can use when trying to meet a target quality. The target minimum and maximum-bits parameters define a range of acceptable numbers of bits producable by the current block. The range usually gives the controller (400) some flexibility in finding a quantization level that meets the target quality while also satisfying bitrate constraints.

When setting the target minimum- and maximum-bits parameters, the target setter (430) considers buffer fullness and target average bit count for the current block.

In one implementation, buffer fullness $B_F$ is measured in terms of fractional fullness of the virtual buffer (490), with the range of $B_F$ extending from 0 (empty) to 1 (full). Target average bit count for the current block (the average number of bits that can be spent encoding a block the size of the current block while maintaining constant bitrate) is:

$$b_{avg} = N_c \cdot \frac{\text{average_bitrate}}{\text{sampling_rate}}, \tag{6}$$

where $N_c$ is the number of transform coefficients (per channel) to be coded in the current block, average_bitrate is the overall, constant bitrate in bits per second, and sample_rate is in samples per second. The target setter (430) also considers the number of transform coefficients (per channel) in the largest possible size block, $N_{max}$.

a. Target Maximum-bits

The target maximum-bits parameter prevents buffer overflow and also prevents the target setter (430) from spending too many bits on the current block when trying to a meet a target quality for the current block. Typically, the target maximum-bits, parameter is a loose bound.

In one implementation, the target maximum-bits parameter is:

$$b_{max}=b_{avg}\mathbf{19}\, f_1(B_F,B_{FSP},N_c,N_{maxx}) \tag{7},$$

where $B_{FSP}$ indicates the sweet spot for fullness of the virtual buffer (490) and $f_1$ is a function that relates input parameters to a factor for mapping the target average bits for the current block to the target maximum-bits parameter for the current block. In most applications, the buffer sweet spot is the mid-point of the buffer (e.g., 0.5 in a range of 0 to 1), but other values are possible. The range of output values for the function $f_1$ in one implementation is from 1 to 10. Typically, the output value is high when $B_F$ is close to 0 or otherwise far below $B_{FSP}$, low when $B_F$ is close to 1 or otherwise far above $B_{FSP}$, and average when $B_F$ is close to $B_{FSP}$. Also, output values are slightly larger when $N_c$ is less than $N_{max}$, compared to output values when $N_c$ is equal to $N_{max}$. The function $f_1$ can be implemented with one or more lookup tables. FIG. 5*a* shows a lookup table for $f_1$ when $B_{FSP} \leqq 0.5$. FIG. 5*b* shows a lookup table for $f_1$ for other values of $B_{FSP}$. Alternatively, the function $f_1$ is a linear function or a different non-linear function of the input parameters listed above, more or fewer parameters, or other input parameters. The function $f_1$ can have a different range of output values or modify parameters other than or in addition to target average bits for the current block.

The target setter (430) makes an additional comparison against the true maximum number of bits still available in the buffer:

$$b_{max}=\min(b_{max},\text{available_buffer_bits}) \tag{8}.$$

This comparison prevents the target maximum-bits parameter from allowing more bits for the current block than the virtual buffer (490) can store. Alternatively, the target setter (430) uses another technique to compute a target maximum-bits, potentially using parameters other than or in addition to the parameters given above.

b. Target Minimum-bits

The target minimum-bits parameter helps guard against buffer underflow and also prevents the target setter (430) from over relying on the target quality parameter. Quality measurement in the controller (400) is not perfect. For example, the measure NER is a non-linear measure and is not completely reliable, particularly in low bitrate, high degradation situations. Similarly, other quality measures that are accurate for high bitrate might be inaccurate for lower bitrates, and vice versa. In view of these limitations, the target minimum-bits parameter sets a minimum bound for the number of bits spent encoding (and hence the quality of) the current block.

In one implementation, the target minimum-bits parameter is:

$$b_{min}=b_{avg}f_2(B_F,B_{FSP},N_c,N_{max}) \tag{9},$$

where $f_2$ is a function that relates input parameters to a factor for mapping the target average bits to the target minimum-bits parameter for the current block. The range of output values for the function $f_2$ is from 0 to 1. Typically, output values are larger when $N_c$ is much less than $N_{max}$, compared to when $N_c$ is close to or equal to $N_{max}$. Also, output values are higher when $B_F$ is low than when $B_F$ is high, and average when $B_F$ is close to $B_{FSP}$. The function $f_2$ can be implemented with one or more lookup tables. FIG. 6 shows a lookup table for $f_2$ which is independent of $B_{FSP}$. Alternatively, the function $f_2$ is a linear function or a different non-linear function of the input parameters listed above, more or fewer parameters, or other input parameters. The function $f_2$ can have a different range of output values or modify parameters other than or in addition to target average bits for the current block.

The target setter (430) makes an additional comparison against the true maximum number of bits still available in the buffer $$b_{min}=\min(b_{min},b_{max}) \tag{10}.$$

This comparison prevents the target minimum-bits parameter from allowing more bits for the current block than the virtual buffer (490) can store (if $b_{max}$=available_buffer_bits) or exceeding the target maximum-bits parameter (if $b_{max}$<available_buffer_bits). Alternatively, the target setter (430) uses another technique to compute a target minimum-bits, potentially using parameters other than or in addition to the parameters given above.

2. Target Quality Parameter

The target setter (430) sets a target quality for the current block. Use of the target quality reduces the number and degree of changes in quality from block to block in the encoder, which makes the transitions between different quality levels smoother and less noticeable.

In one implementation, the quantization loop (450) measures achieved quality in terms of NER (namely, $NER_{achieved}$). Accordingly, the target setter (430) estimates a comparable quality measure (namely, $NER_{target}$) for the current block based upon various available information, including the complexity of past audio information, an estimate of the complexity of future audio information, current buffer fullness, current block size. Specifically, the target setter (430) computes $NER_{target}$ as the ratio of a composite complexity estimate for the current block to a goal number of bits for the current block:

$$NER_{target} = \frac{\alpha_{composite}}{b_{tmp}}. \tag{11}$$

where $b_{tmp}$, the goal number of bits, is defined in equation (14) or (15).

The series of $NER_{target}$ values determined this way are fairly smooth from block to block, ensuring smooth quality of reproduction while satisfying buffer constraints.

a. Goal Number of Bits

For the goal number of bits, the target setter (430) computes the desired trajectory of buffer fullness—the desired rate for buffer fullness to approach the buffer sweet spot. Specifically, the target setter (430) computes the desired buffer fullness $B_F^{desired}$ for the current time:

$$B_F^{desired}=f_3(B_F,B_{FSP}) \quad (12).$$

The function $f_3$ relates the current buffer fullness $B_F$ and the buffer sweet spot $B_{FSP}$ to the desired buffer fullness, which is typically somewhere between the current buffer fullness and the buffer sweet spot. The function $f_3$ can be implemented with one or more lookup tables. FIG. 7*a* shows a lookup table for the function $f_3$ when $B_{FSP}\leqq 0.5$. FIG. 7*b* shows a lookup table for the function $f_3$ for other values of $B_{FSP}$. Alternatively, the function $f_3$ is a linear function or a different non-linear function of the input parameters listed above, more or fewer parameters, or other input parameters.

The target setter (430) also computes the number of frames $N_b$ it should take to arrive at the desired buffer fullness:

$$N_b=f_4(B_F,B_{FSP}) \quad (13),$$

where the function $f_4$ relates the current buffer fullness $B_F$ and the buffer sweet spot $B_{FSP}$ to the reaction time (in frames) that the controller should follow to reach the desired buffer fullness. The reaction time is set to be neither too fast (which could cause too much fluctuation between quality levels) nor too slow (which could cause. unresponsiveness). In general, when the buffer fullness is within a safe zone around the buffer sweet spot, the target setter (430) focuses more on quality than bitrate and allows a longer reaction time. When the buffer fullness is near an extreme, the target setter (430) focuses more on bitrate than quality and requires a quicker reaction time. The range of output values for the function in one implementation of $f_4$ is from 6 to 60 frames. The function $f_4$ can be implemented with one or more lookup tables. FIG. 8*a* shows a lookup table for the function $f_4$ when $B_{FSP}\leqq 0.5$. FIG. 8*b* shows a lookup table for the function $f_4$ for other values of $B_{FSP}$. Alternatively, the function $f_4$ is a linear function or a different non-linear function of the input parameters listed above, more or fewer parameters, or other input parameters. The function $f_4$ can have a different range of output values.

The target setter (430) then computes the goal number of bits that should be spent encoding the current block while following the desired trajectory:

$$b_{tmp}b_{avg}\cdot\frac{N_{\max}}{N_c}+\frac{(B_F^{desired}-B_F)}{N_b}\cdot\text{buffer_size}, \quad (14)$$

buffer_size is the size of the virtual buffer in bits. The target setter (430) normalizes the target average number of bits for the current block to the largest block size, and then further adjusts that amount according to the desired trajectory to reach the buffer sweet spot. By normalizing the target average number of bits for the current block to the largest block size, the target setter (430) makes estimation of the goal number of bits from block to block more continuous when the blocks have variable size.

In some embodiments, computation of the goal number of bits $b_{tmp}$ ends here. In an alternative embodiment, the target setter (430) checks that the goal number of bits $b_{tmp}$ for the current block has not fallen below the target minimum number of bits $b_{min}$ for the current block, normalized to the largest block size:

$$b_{tmp}=\text{Max}\left(b_{tmp},\left(b_{\min}\cdot\left(\frac{N_{\max}}{N_c}\right)\right)\right). \quad (15)$$

Figure 9:
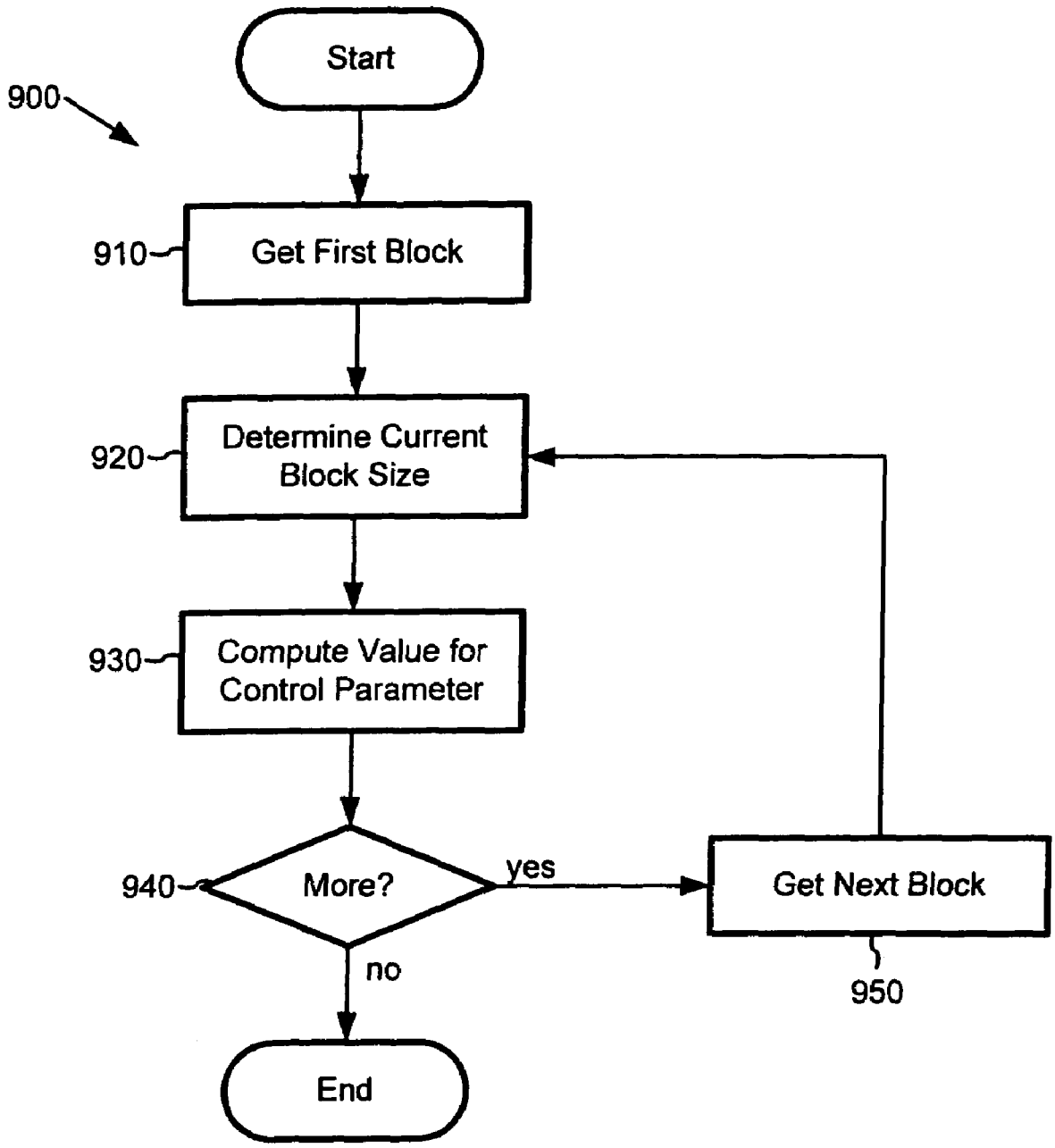
FIG. 9 is a flowchart showing a technique for normalizing block size when computing values for a control parameter for a block according to the illustrative embodiment.

FIG. 9 shows a technique (900) for normalizing block size when computing values for a control parameter for variable-size blocks, in a broader context than the target setter (430) of FIG. 4. A tool such as an audio encoder gets (910) a first variable-size block and determines (920) the size of the variable-size block. The variable-size block is, for example, a variable-size transform block of frequency coefficients.

Next, the tool computes (930) a value of a control parameter for the block, where normalization compensates for variation in block size in the value of the control parameter. For example, the tool weights a value of a control parameter by the ratio between the maximum block size and the current block size. Thus, the influence of varying block sizes is reduced in the values of the control parameter from block to block. The control parameter can be a goal number of bits, a past complexity estimate parameter, or another control parameter.

If the tool determines (940) that there are no more blocks to compute values of the control parameter for, the technique ends. Otherwise, the tool gets (950) the next block and repeats the process. For the sake of simplicity, FIG. 9 does not show the various ways in which the technique (900) can be used in conjunction with other techniques in a rate/quality controller or encoder.

b. Composite Complexity Estimate

The target setter (430) also computes a composite complexity estimate for the current block:

$$\alpha_{composite}=\frac{x\cdot\alpha_{past}^{filt}\cdot(1-\gamma_{past}^{filt})+y\cdot\alpha_{future}\cdot(1-\gamma_{future}^{filt})}{x\cdot(1-\gamma_{past}^{filt})+y\cdot(1-\gamma_{future}^{filt})}, \quad (16)$$

where $\alpha_{future}$ is the future complexity estimate from the future complexity estimator (410) and $\alpha_{past}^{filt}$ is a past complexity measure. Although $\alpha_{future}$ is not filtered per se, in one implementation it is computed as an average of transient strengths. The noise measures $\gamma_{past}^{filt}$ and $\gamma_{future}^{filt}$ indicate the reliability of the past and future complexity parameters, respectively, where a value of 1 indicates complete unreliability and a value of 0 indicates complete reliability. The noise measures affect the weight given to past and future information in the composite complexity based upon the estimated reliabilities of the past and future complexity parameters. The parameters x and y are implementation-dependent factors that control the relative weights given to past and future complexity measures, aside from the reliabilities of those measures. In one implementation, the parameters x and y are derived experimentally and given equal values. The denominator of equation 15 can include an additional small value to guard against division by zero.

Alternatively, the target setter (430) uses another technique to compute a composite complexity estimate, goal number of bits, and/or target quality for the current block, potentially using parameters other than or in addition to the parameters given above.

C. Quantization Loop

The main goal of the quantization loop (450) is to achieve the target quality and bit-count parameters. A secondary goal is to satisfy these parameters in as few iterations as possible.

Figure 10:
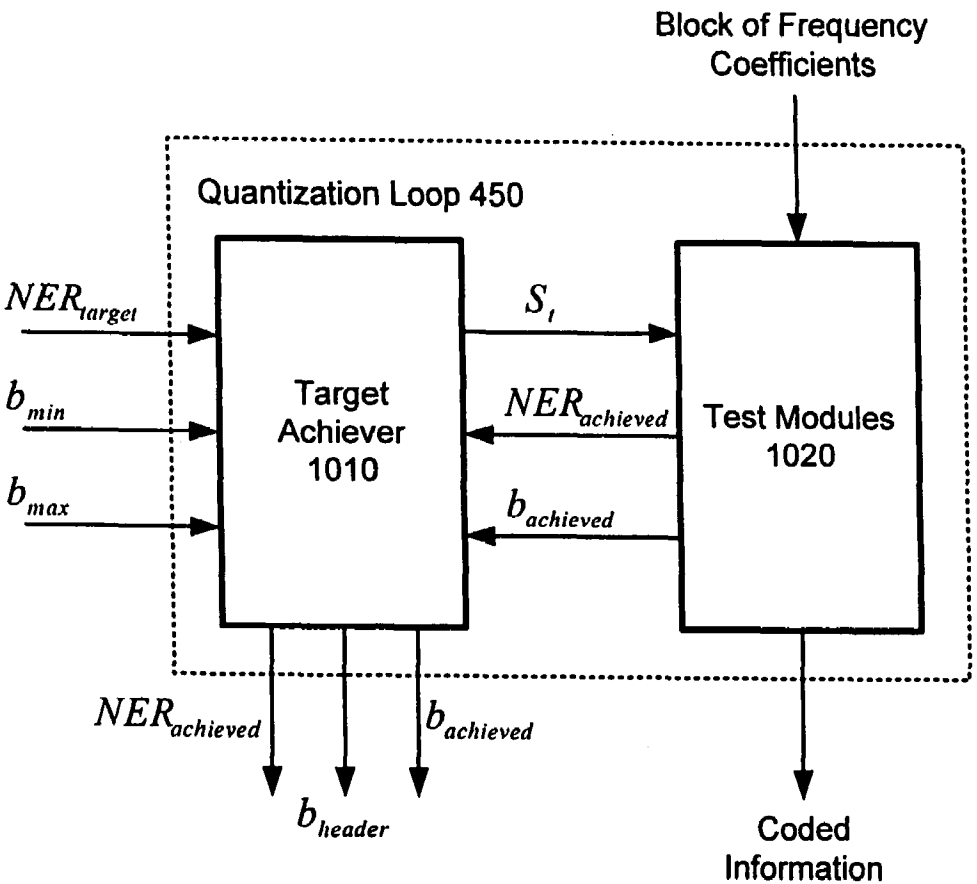
FIG. 10 is a block diagram of a quantization loop according to the illustrative embodiment.

FIG. 10 shows a diagram of a quantization loop (450). The quantization loop (450) includes a target achiever (1010) and one or more test modules (1020) (or calls to test modules (1020)) for testing candidate quantization step sizes. The quantization loop (450) receives the parameters $NER_{target}$, $b_{min}$, and $b_{max}$ as well as a block of frequency coefficients. The quantization loop (450) tries various quantization step sizes for the block until all target parameters are met or the encoder determines that all target parameters cannot be simultaneously satisfied. The quantization loop (450) then outputs the coded block of frequency coefficients as well as parameters for the achieved quality ($NER_{achieved}$), achieved bits ($b_{achieved}$), and header bits ($b_{header}$) for the block.

1. Test Modules

One or more of the test modules (1020) receive a test step size $s_t$ from the target achiever (1010) and apply the test step size to a block of frequency coefficients. The block was previously frequency transformed and, optionally, multi-channel transformed for multi-channel audio. If the block has not been weighted by its quantization matrix, one of the test modules (1020) applies the quantization matrix to the block before quantization with the test step size.

One or more of the test modules (1020) measure the result. For example, depending on the stage of the quantization loop (450), different test modules (1020) measure the quality ($NER_{achieved}$) of a reconstructed version of the frequency coefficients or count the bits spent entropy encoding the quantized block of frequency coefficients ($b_{achieved}$).

The test modules (1020) include or incorporate calls to: 1) a quantizer for applying the test step size (and, optionally, the quantization matrix) to the block of frequency coefficients; 2) an entropy encoder for entropy encoding the quantized frequency coefficients, adding header information, and counting the bits spent on the block; 3) one or reconstruction modules (e.g., inverse quantizer, inverse weighter, inverse multi-channel transformer) for reconstructing quantized frequency coefficients into a form suitable for quality measurement; and 4) a quality measurement module for measuring the perceptual quality (NER) of reconstructed audio information. The quality measurement module also takes as input the original frequency coefficients. Not all test modules (1020) are needed in every measurement operation. For example, the entropy-encoder is not needed for quality measurement, nor are the reconstruction modules or quality measurement module needed to evaluate bitrate.

2. Target Achiever

The target achiever (1010) selects a test step size and determines whether the results for the test step size satisfy target quality and/or bit-count parameters. If not, the target achiever (1010) selects a new test step size for another iteration.

Typically, the target achiever (1010) finds a quantization step size that satisfies both target quality and target bit-count constraints. In rare cases, however, the target achiever (1010) cannot find such a quantization step size, and the target achiever (1010) satisfies the bit-count targets but not the quality target. The target setter (1010) addresses this complication by de-linking a quality control quantization loop and a bit-count control quantization loop.

Figure 11:
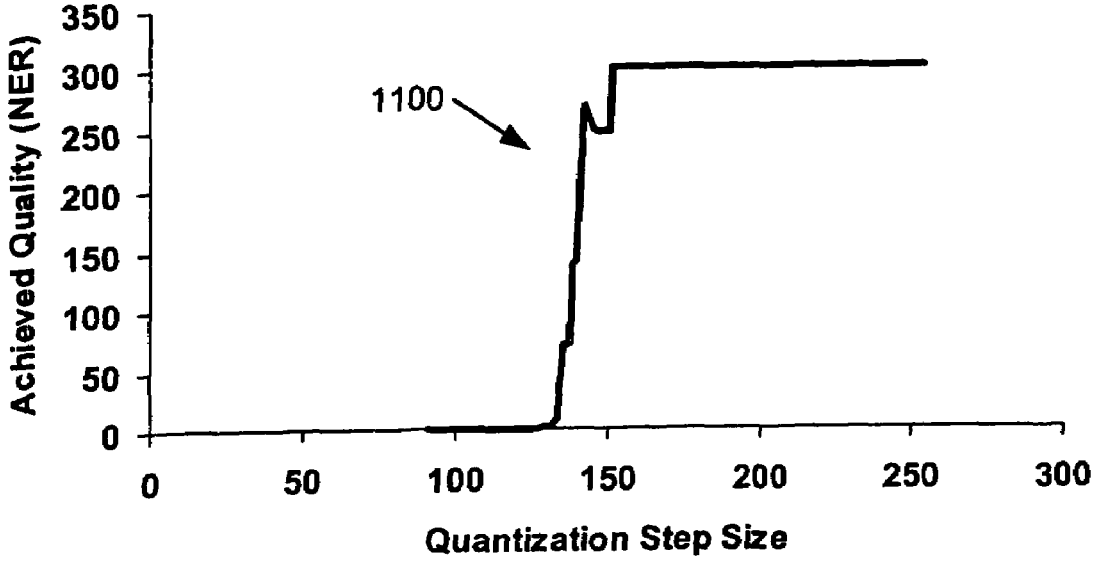
FIG. 11 is a chart showing a trace of noise to excitation ratio as a function of quantization step size for a block according to the illustrative embodiment.

Another complication for the target achiever (1010) is that measured quality is not necessarily a monotonic function of quantization step size, due to limitations of the rate/quality model. For example, FIG. 11 shows a trace (1100) of $NER_{achieved}$ as a function of quantization step size for a block of frequency coefficients. For most quantization step sizes, NER increases (i.e., perceived quality worsens) as quantization step size increases. For certain step sizes, however, NER decreases (i.e., perceived quality improves) as quantization step size increases. To address this complication, the target setter (1010) checks for non-monotonicity and judiciously selects step sizes and search ranges in the quality control quantization loop.

Figure 12:
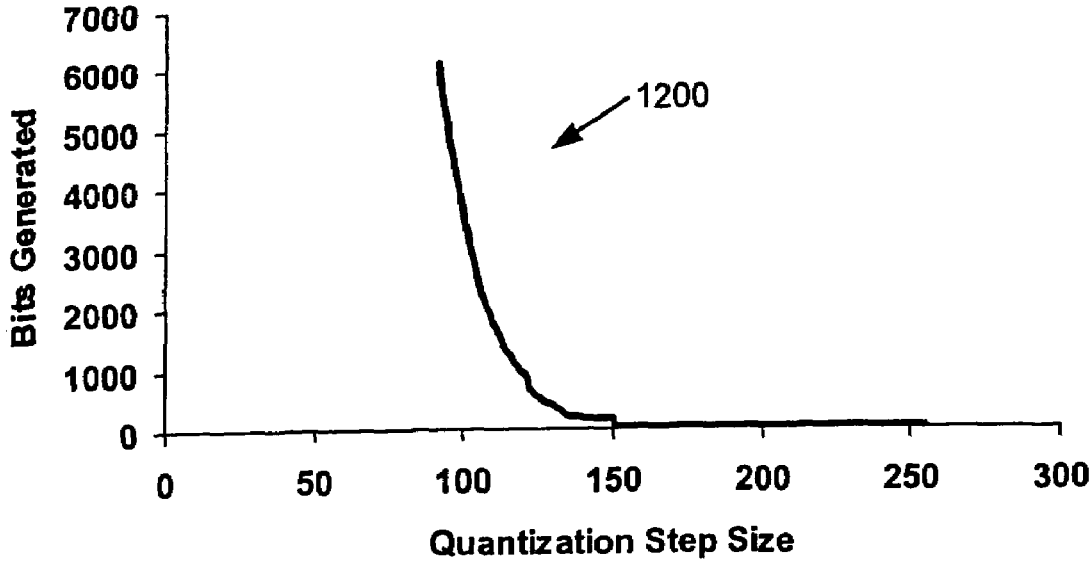
FIG. 12 is a chart showing a trace of number of bits produced as a function of quantization step size for a block according to the illustrative embodiment.

For comparison, FIG. 12 shows a trace (1200) of $b_{achieved}$ as a function of quantization step size for the block of frequency coefficients. Bits generated for the block is a monotonically decreasing function with increasing quantization step size; $b_{achieved}$ for the block always decreases or stays the same as step size increases.

3. De-linked Quantization Loops

Figure 13:
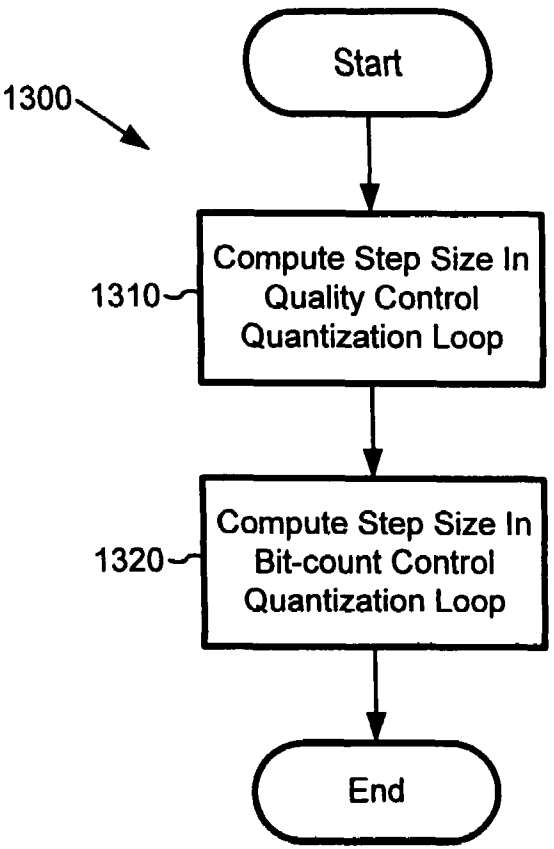
FIG. 13 is a flowchart showing a technique for controlling quality and bitrate in de-linked quantization loops according to the illustrative embodiment.

The controller (400) attempts to satisfy the target quality and bit-count constraints using de-linked quantization loops. Each iteration of one of the de-linked quantization loops involves the target achiever (1010) and one or more of the test modules (1020). FIG. 13 shows a technique (1300) for determining a quantization step size in a bit-count control quantization loop following and de-linked from a quality control quantization loop.

The controller (400) first computes (1310) a quantization step size in a quality control quantization loop. In the quality control loop, the controller (400) tests step sizes until it finds one ($s_{NER}$) that satisfies the target quality constraint. An example of a quality control quantization loop is described below.

The controller (400) then computes (1320) a quantization step size in a bit-count control quantization loop. In the bit-count control loop, the controller (400) fist tests the step size ($s_{NER}$) found in the quality control loop against the target-bit (minimum and maximum-bit) constraints. If the target-bit constraints are satisfied, the bit-count control loop ends ($s_{final}=s_{NER}$). Otherwise, the controller (400) tests other step sizes until it finds one that satisfies the bit-count constraints. An example of a bit-count control quantization loop is described below.

In most cases, the quantization step size that satisfies the target quality constraint also satisfies the target bit-count constraints. This is especially true if the target bit-count constraints define a wide range of acceptable bits produced, as is common with target minimum- and maximum-bits parameters.

In rare cases, the quantization step size that satisfies the target quality constraint does not also satisfy the target-bit constraints. In such cases, the bit count control loop continues to search for a quantization step size that satisfies the target-bit constraints, without additional processing overhead of the quality control loop.

The output of the de-linked quantization loops includes the achieved quality ($NER_{achieved}$) and achieved bits ($b_{achieved}$) for the block as quantized with the final quantization step size $s_{final}$.

a. Quality Control Quantization Loop

Figure 14:
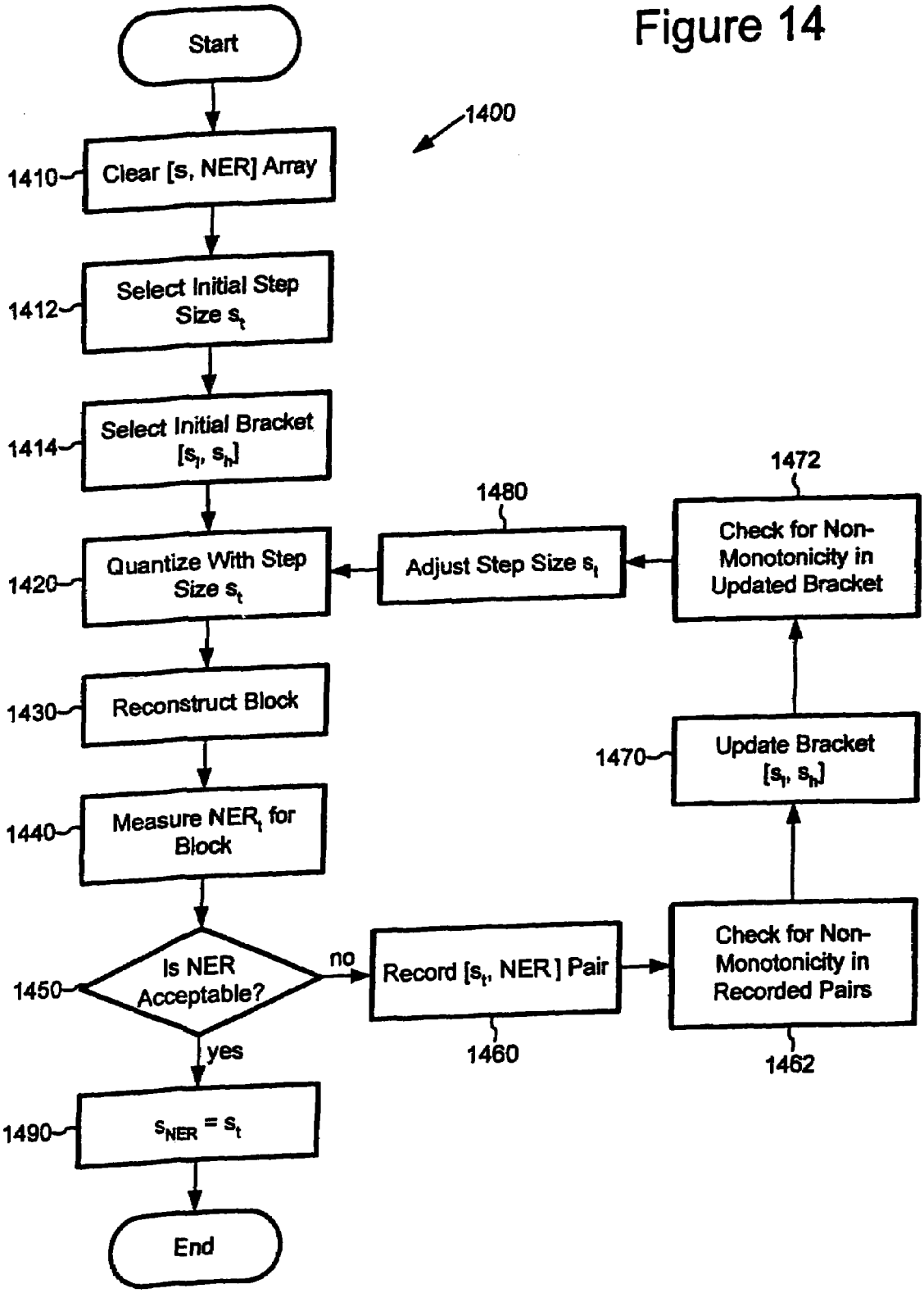
FIG. 14 is a flowchart showing a technique for computing a quantization step size in a quality control quantization loop according to the illustrative embodiment.

FIG. 14 shows a technique (1400) for an exemplary quality control quantization loop in an encoder. In the quality control loop, the encoder addresses non-monotonicity of quality as a function of step size when selecting step sizes and search ranges.

The encoder first initializes the quality control loop. The encoder dears (1410) an array that stores pairs of step sizes and corresponding achieved MAR measures (i.e., an [s,NER] array).

The encoder selects (1412) an initial step size $s_t$. In one implementation, the encoder selects (1412) the initial step size based upon the final step size of the previous block as well as the energies and target qualities of the current and previous blocks. For example, starting from the final step size of the previous block, the encoder adjusts the initial step size based upon the relative energies and target qualities of the current and previous blocks.

The encoder then selects (1414) an initial bracket $[s_t,s_h]$ for a search range for step sizes. In one implementation, the initial bracket is based upon the initial step size and the overall limits on allowable step sizes. For example, the initial bracket is centered at the initial step size, extends upward to the step size nearest to $1.25 \cdot s_t$, and extends downward to the step size nearest to $0.75 \cdot s_t$, but not past the limits of allowable step sizes.

The encoder next quantizes (1420) the block with the step size $s_t$. For example, the encoder quantizes each frequency coefficient of a block by a uniform, scalar quantization step size.

In order to evaluate the achieved quality given the step size $s_t$, the encoder reconstructs (1430) the block. For example, the encoder applies an inverse quantization, inverse weighting, and inverse multi-channel transformation. The encoder then measures (1440) the achieved NER given the step size $s_t$ (i.e., $NER_t$).

The encoder evaluates (1450) the acceptability of the achieved quality NER, for the step size $s_t$ in comparison to the target quality measure $NER_{target}$. If the achieved quality is acceptable, the encoder sets (1490) the final step size for the quality control loop equal to the test step size (i.e., $s_{NER}=s_t$). In one implementation, the encoder evaluates (1450) the acceptability of the achieved quality by checking whether it falls within a tolerance range around the target quality:

$$|NER_{target}-NER_t| \leqq Tolerance_{NER} \cdot NER_{target} \quad (17),$$

where $Tolerance_{NER}$ is a predefined or adaptive factor that defines the tolerance range around the target quality measure. In one implementation, $Tolerance_{NER}$ is 0.05, so the $NER_t$ is acceptable if it is within ±5% of $NER_{target}$.

If the achieved quality for the test step size is not acceptable, the encoder records (1460) the pair $[s_t, NER_t]$ in the [s, NER] array. The pair $[s_t, NER_t]$ represents a point on a trajectory of NER as a function of quantization step size. The encoder checks (1462) for non-monotonicity in the recorded pairs in the [s, NER] array. For example, the encoder checks that NER does not decrease with any increase between step sizes. If a particular trajectory point has larger NER at a lower step size than another point on the trajectory, the encoder detects non-monotonicity and marks the particular trajectory point as inferior so that the point is not selected as a final step size.

If the trajectory is monotonic, the encoder updates (1470) the bracket $[s_t,s_h]$ to be the sub-bracket $[s_t,s_t]$ or $[s_t,s_h]$ depending on the relation of $NER_t$ to the target quality. In general, if $NER_t$ is higher (worse quality) than $NER_{target}$, the encoder selects the sub-bracket $[s_t,s_t]$ so that the next $s_t$ is lower, and vice versa. An exception to this rule applies if the encoder determines that the final step size is outside the bracket $[s_t,s_h]$. If NER at the lowest step size in the bracket is still higher than $NER_{target}$, the encoder slides the bracket $[s_t,s_h]$ by updating it to be $[s_t-x,s_t]$, where x is an implementation-dependent constant. In one implementation, x is 1 or 2. Similarly, if NER at the highest step size in the bracket is still lower (better quality) than $NER_{target}$, the bracket $[s_t,s_h]$ is updated to be $[s_h,s_h+x]$.

If the trajectory is non-monotonic, the encoder does not update the bracket, but instead selects the next step size from within the old bracket as described below.

If the bracket was updated, the encoder checks (1472) for non-monotonicity in the updated bracket. For example, the encoder checks the recorded [s, NER] points for the updated bracket.

The encoder next adjusts (1480) the step size $s_t$ for the next iteration of the quality control loop. The adjustment technique differs depending on the monotonicity of the bracket, how many points of the bracket are known, and whether any endpoints are marked as inferior points. By switching between adjustment techniques, the encoder finds a satisfactory step size faster than with methods such as binary search, while also accounting for non-monotonicity in quality as a function of step size.

If all the step sizes in the range $[s_t,s_h]$ have been tested, the encoder selects one of the step sizes as the final step size $s_{NER}$ for the quality control loop. For example, the encoder selects the step size with NER closest to $NER_{target}$.

Otherwise, the encoder selects the next step size $s_t$ from within the range $[s_t,s_h]$. This process is different depending on the monotonicity of the bracket.

If the trajectory of the bracket is monotonic, and $s_t$ or $s_h$ is untested or marked inferior, the encoder selects the midpoint of the bracket as the next test step size:

$$s_i = \left\lfloor \frac{s_l + s_h}{2} \right\rfloor. \quad (18)$$

Otherwise, if the trajectory of the bracket is monotonic, and both $s_t$ and $s_h$ have been tested and are not marked inferior, the encoder estimates that the step size $s_{NER}$ lies within the bracket $[s_t,s_h]$. The encoder selects the next test step size $s_t$ according to an interpolation rule using $[s_t, NER_t]$ and $[s_h,NER_h]$ as data points. In one implementation, the interpolation rule assumes a linear relation between $\log_{10}$ NER and $10^{-s/20}$ (with a negative slope) for points between $[s_t, NER_t]$ and $[s_h, NER_h]$. The encoder plots $NER_{target}$ on this estimated relation to find the next test step size $s_t$.

If the trajectory is non-monotonic, the encoder selects as the next test step size $s_t$ one of the step sizes yet to be tested in the bracket $[s_t,s_h]$. For example, for a fast sub-range between $s_t$ and an inferior point and a second sub-range between the inferior point and $s_h$, the encoder selects a trajectory point in a sub-range that the encoder knows or estimates to span the target quality. If the encoder knows or estimates that both sub-ranges span the target quality, the encoder selects a trajectory point in the higher sub-range.

Alternatively, the encoder uses a different quality control quantization loop, for example, one with different data structures, a quality measure other than NER, different rules for evaluating acceptability, different step size selection rules, and/or different bracket updating rules.

b. Bit-count Control Quantization Loop

Figure 15:
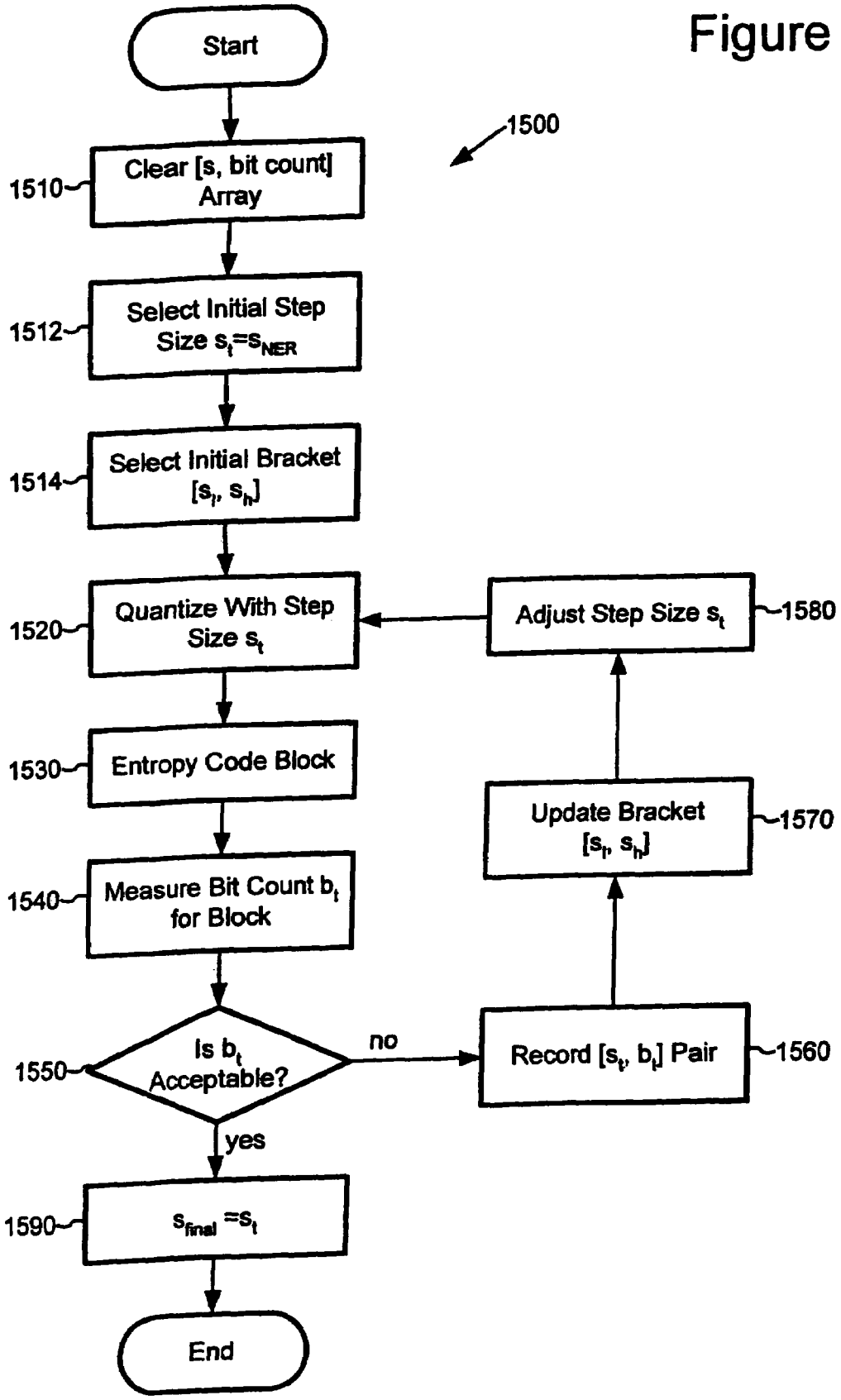
FIG. 15 is a flowchart showing a technique for computing a quantization step size in a bit-count control quantization loop according to the illustrative embodiment.

FIG. 15 shows a technique (1500) for an exemplary bit-count control quantization loop in an encoder. The bit-count control loop is simpler than the quality control loop because bit count is a monotonically decreasing function of increasing quantization step size, and the encoder need not check for non-monotonicity. Another major difference between the bit-count control loop and the quality control loop is that the bit-count control loop does not include reconstruction/quality measurement, but instead includes entropy encoding/bit counting. In practice, the quality control loop usually includes more iterations than the bit-count control loop (especially for wider ranges of acceptable bit counts) and the final step size $s_{NER}$ of the quality control loop is acceptable or close to an acceptable step size in the bit-count control loop.

The encoder first initializes the bit-count control loop. The encoder clears (1510) an array that stores pairs of step sizes and corresponding achieved bit-count measures (i.e., an [s,b] array). The encoder selects (1512) an initial step size $s_t$ for the bit-count loop to be the final step size $s_{NER}$ of the quality control loop.

The encoder then selects (1514) an initial bracket $[s_t,s_h]$ for a search range for step sizes. In one implementation, the initial bracket $[s_t,s_h]$ is based upon the initial step size and the overall limits on allowable step sizes. For example, the initial bracket is centered at the initial step size and extends outward for two step sizes up and down, but not past the limits of allowable step sizes.

The encoder next quantizes (1520) the block with the step size $s_t$. For example, the encoder quantizes each frequency coefficient of a block by a uniform, scalar quantization step size. Alternatively, for the first iteration of the bit-count control loop, the encoder uses already quantized data from the final iteration of the quality control loop.

Before measuring the bits spent encoding the block given the step size $s_t$, the encoder entropy encodes (1530) the block. For example, the encoder applies a run-level Huffman coding and/or another entropy encoding technique to the quantized frequency coefficients. The encoder then counts (1540) the number of produced bits, given the test step size $s_t$ (i.e., $b_t$).

The encoder evaluates (1550) the acceptability of the produced bit count $b_t$ for the step size $s_t$ in comparison to each of the target-bits parameters. If the produced bits satisfy target-bit constraints, the encoder sets (1590) the final step size for the bit-count control loop equal to the test step size (i.e., $s_{final}=s_t$). In one implementation, the encoder evaluates (1550) the acceptability of the produced bit count $b_t$ by checking whether it satisfies the target minimum-bits parameter $b_{min}$ and the target maximum-bits parameter $b_{max}$:

$$b_t \geqq b_{min} \quad (19),$$

$$b_t \leqq b_{max} \quad (20).$$

Satisfaction of the target maximum-bits parameter $b_{max}$ is a necessary condition to guard against buffer overflow. Satisfaction of the target minimum-bits parameter $b_{min}$ may not be possible, however, for a block such as a silence block. In such cases, if the step size cannot be lowered anymore, the lowest step size is accepted.

If the produced bit count for the test step size is not acceptable, the encoder records (1560) the pair $[s_t,b_t]$ in the [s,b] array. The pair $[s_t,b_t]$ represents a point on a trajectory of bit count as a function of quantization step size.

The encoder updates (1570) the bracket $[s_t,s_h]$ to be the sub-bracket $[s_t,s_t]$ or $[s_t,s_h]$, depending on which of the target-bits parameters $b_t$ fails to satisfy. If $b_t$ is higher than $b_{max}$, the encoder selects the sub-bracket $[s_t,s_h]$ so that the next $s_t$ is higher, and if $b_t$ is lower than $b_{min}$, the encoder selects the sub-bracket $[s_t,s_t]$ so that the next $s_t$ is lower.

An exception to this rule applies if the encoder determines that the final step size is outside the bracket $[s_t,s_h]$. If the produced bit count at the lowest step size in the bracket is lower than $b_{min}$, the encoder slides the bracket $[s_t,s_h]$ by updating it to be $[s_t-x,s_t]$, where x is an implementation-dependent constant. In one implementation, x is 1 or 2. Similarly, if the produced bit count at the highest step size in the bracket is higher than $b_{max}$, the encoder slides the bracket $[s_t,s_h]$ is updated to be $[s_h,s_h+x]$. This exception to the bracket-updating rule is more likely for small initial bracket sizes.

The encoder adjusts (1580) the step size $s_t$ for the next iteration of the bit-count control loop. The adjustment technique differs depending upon how many points of the bracket are known. By switching between adjustment techniques, the encoder finds a satisfactory step size faster than with methods such as binary search.

If all the step sizes in the range $[s_t,s_h]$ have been tested, the encoder selects one of the step sizes as the final step size $s_{final}$ for the bit-count control loop. For example, the encoder selects the step size with corresponding bit count closest to being within the range of acceptable bit counts.

Otherwise, the encoder selects the next step size $s_t$ from within the range $[s_t,s_h]$. If $s_t$ or $s_h$ is untested, the encoder selects the midpoint of the bracket as the next test step size:

$$s_i = \left\lfloor \frac{s_l + s_h}{2} \right\rfloor. \quad (21)$$

Otherwise, both $s_t$ and $s_h$ have been tested, and the encoder estimates that the final step size lies within the bracket $[s_t,s_h]$. The encoder selects the next test step size $s_t$ according to an interpolation rule using $[s_t, b_t]$ and $[s_h,b_h]$ as data points. In one implementation, the interpolation rule assumes a linear relation between bit count and $10^{-s/20}$ for points between $[s_t, b_t]$ and $[s_h,b_h]$. The encoder plots a bit count that satisfies the target-bits parameters on this estimated relation to find the next test step size $s_t$.

Alternatively, the encoder uses a different bit-count control quantization loop, for example, one with different data structures, different rules for evaluating acceptability, different step size selection rules, and/or different bracket updating rules.

D. Model Updater

The model parameter updater (470) tracks several control parameters used in the controller (400). The model parameter updater (470) updates certain control parameters from block to block, improving the smoothness of quality in the encoder. In addition, the model parameter updater (470) detects and corrects systematic mismatches between the model used by the controller (400) and the audio information being compressed, which prevents the accumulation of errors in the controller (400).

The model parameter updater (470) receives various control parameters for the current block, including: the total number of bits $b_{achieved}$ spent encoding the block as quantized by the final step size of the quantization loop, the total number of header bits $b_{header}$, the final achieved quality $NER_{achieved}$, and the number of transform coeffcients (per channel) $N_c$. The model parameter updater (470) also receives various control parameters indicating the current state of the encoder or encoder settings, including: current buffer fullness $B_F$, buffer fullness sweet spot $B_{FSP}$, and the number of transform coefficients (per channel) in the largest possible size block $N_{max}$.

1. Bias Correction

To reduce the impact of systematic mismatches between the rate/quality model used in the controller (400) and audio information being compressed, the model parameter updater (470) detects and corrects biases in the fullness of the virtual buffer (490). This prevents the accumulation of errors in the controller (400) that could otherwise hurt quality.

One possible source of systematic mismatches is the number of header bits $b_{header}$ generated for the current block. The number of header bits does not relate to quantization step size in the same way as the number of payload bits (e.g., bits for frequency coefficients). Varying step size to satisfy quality and bit-count constraints can dramatically alter $b_{achieved}$ for a block, while altering $b_{header}$ much less or not at all. At low bitrates in particular, the high proportion of $b_{header}$ within $b_{achieved}$ can cause errors in target quality estimation. Accordingly, the encoder corrects bias in $b_{achieved}$:

$$b_{corrected}=b_{achieved}+f_5(B_F,B_{FSP},b_{header},b_{achieved}) \quad (22),$$

where the function $f_5$ relates the input parameters to an amount of bits by which $b_{achieved}$ should be corrected. In general, the bias correction relates to the difference between $B_{FSP}$ and $B_F$, and to the proportion of $b_{header}$ to $b_{achieved}$. The function $f_5$ can be implemented with one or more lookup tables. FIG. 16 shows a lookup table for the function $f_5$ in which the amount of bias correction depends mainly on $b_{header}$ if $b_{header}$ is a large proportion of $b_{achieved}$, and mainly on $b_{achieved}$ if $b_{header}$ is a small proportion of $b_{achieved}$. The direction of the bias correction depends on $B_F$ and $B_{FSP}$. If $B_F$ is high, the bias correction is used for a downward adjustment of $b_{achieved}$, and vice versa. If $B_F$ is close to $B_{FSP}$, no adjustment of $b_{achieved}$ occurs. Alternatively, the function $f_5$ is a linear function or a different non-linear function of the input parameters listed above, more or fewer parameters, or other input parameters.

In alternative embodiments, the model parameter updater (470) corrects a source of systematic mismatches other than the number of header bits $b_{header}$ generated for the current block.

Figure 17:
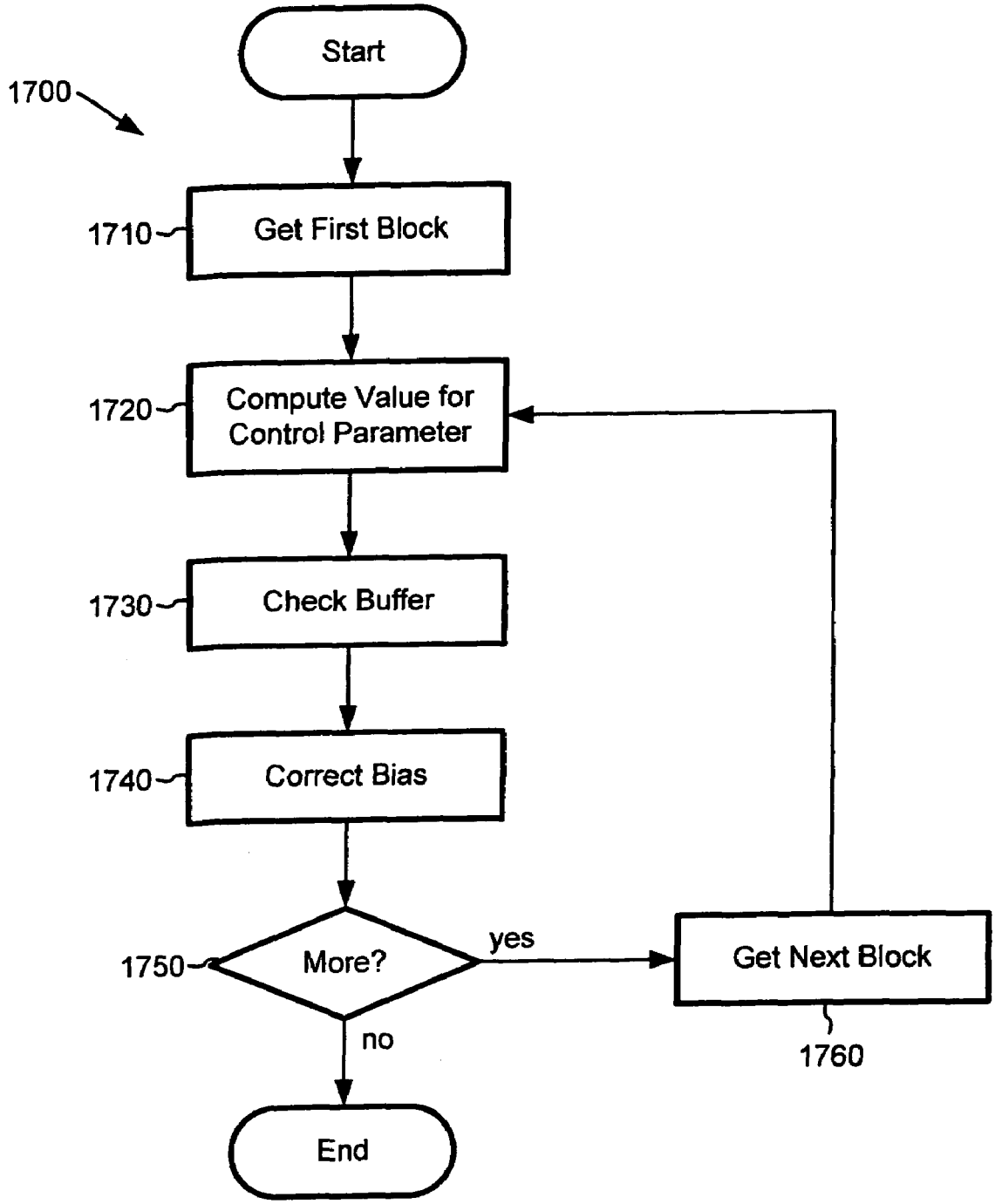
FIG. 17 is a flowchart showing a technique for correcting model bias by adjusting a value of a control parameter according to the illustrative embodiment.

FIG. 17 shows a technique (1700) for correcting model bias by adjusting the values of a control parameter from block to block, in a broader context than the model parameter updater (470) of FIG. 4. A tool such as an audio encoder gets (1710) a first block and computes (1720) a value of a control parameter for the block For example, the tool computes the number of bits achieved coding a block of frequency coefficients quantized at a particular step size.

The tool checks (1730) a (virtual) buffer. For example, the tool determines tow current fullness of the buffer. The tool then corrects (1740) bias in the model, for example, using the current buffer fullness information and other information to adjust the value computed for the control parameter. Thus, the tool corrects model bias by adjusting the value of the control parameter based upon actual buffer feedback, where the adjustment tends to correct bias in the model for subsequent blocks.

If the tool determines (1750) that there are no more blocks to compute values of the control parameter for, the technique ends. Otherwise, the tool gets (1760) the next block and repeats the process. For the sake of simplicity, FIG. 17 does not show the various ways in which the technique (1700) can be used in conjunction with other techniques in a rate/quality controller or encoder.

2. Control Parameter Updating

The target parameter updater (470) computes the complexity of the just encoded block, normalized to the maximum block size:

$$\alpha_{past} = b_{corrected} \cdot NER_{achieved} \cdot \frac{N_{\max}}{N_c}, \quad (23)$$

The target parameter updater (470) filters the value for $\alpha_{past}$ as part of a sequence of zero or more previously computed values for $\alpha_{past}$, producing a filtered past complexity measure value $\alpha_{past}^{filt}$. In one implementation, the target parameter updater (470) uses a lowpass filter to smooth the values of $\alpha_{past}$ over time. Smoothing the values of $\alpha_{past}$ leads to smoother quality. (Outlier values for $\alpha_{past}$ can cause inaccurate estimation of target quality for subsequent blocks, resulting in unnecessary variations in the achieved quality of the subsequent blocks.)

The target parameter updater (470) then computes a past complexity noise measure $\gamma_{past}$, which indicates the reliability of the past complexity measure. When used in computing another control parameter such as composite complexity of a bock, the noise measure $\gamma_{past}$ can indicate how much weight should be given to the past complexity measure. In one implementation, the target parameter updater (470) computes the past complexity noise measure based upon the variation between the past complexity measure and the filtered past complexity measure:

$$\gamma_{past} = \frac{\left|\alpha_{past}^{filt} - \alpha_{past}\right|}{\alpha_{past}^{filt} + \varepsilon}, \quad (24)$$

where $\epsilon$ is small value that prevents a divide by zero. The target parameter updater (470) then constrains the past complexity noise measure to be within 0 and 1:

$$\gamma_{past}=\max(0,\min(1,\gamma_{past})) \quad (25),$$

where 0 indicates a reliable past complexity measure and 1 indicates an unreliable past complexity measure.

The target parameter updater (470) filters the value for the $\gamma_{past}$ as part of a sequence of zero or more previously computed $\gamma_{past}$ values, producing a filtered past complexity noise measure value $\gamma_{past}^{filt}$. In one implementation, the target parameter updater (470) uses a lowpass filter to smooth the values of $\gamma_{past}$ over one. Smoothing the values of $\gamma_{past}$ leads to smoother quality by moderating outlier values that might otherwise cause unnecessary variations in the achieved quality of the subsequent blocks.

Having computed control parameters for the complexity of the just encoded block, the target parameter updater (470) next computes control parameters for modeling the complexity of future audio information. In general, the control parameters for modeling future complexity extrapolate past and current trends in the audio information into the future.

The target parameter updater (470) maps the relation between the past complexity measure and the composite strength for the block (which was estimated in the future complexity estimator (470)):

$$\beta = \frac{\alpha_{past}}{CompositeStrength}. \quad (26)$$

The target parameter updater (470) filters the value for $\beta$ as part of a sequence of zero or more previously computed values for $\beta$, producing a filtered mapped relation value $\beta_{filt}$. In one implementation, the target parameter updater (470) uses a lowpass filter to smooth the values of $\beta$ over time, which leads to smoother quality by moderating outlier values. The future complexity estimator (470) uses $\beta_{filt}$ to scale composite strength for a subsequent block into a future complexity measure for the subsequent block.

The target parameter updater (470) then computes a future complexity noise measure $\gamma_{future}$, which indicates the expected reliability of a future complexity measure. When used in computing another control parameter such as composite complexity of a block, the noise measure $\gamma_{future}$ can indicate how much weight should be given to the future complexity measure. In one implementation, the target parameter updater (470) computes the future complexity noise measure based upon the variation between a prediction of the future complexity measure (here, the past complexity measure) and the filtered past complexity measure:

$$\gamma_{future} = \frac{\left|\alpha_{past}^{filt} - \beta_{filt} \cdot CompositeStrength\right|}{\alpha_{past}^{filt} + \varepsilon}, \tag{27}$$

where $\epsilon$ is small value that prevents a divide by zero. The target parameter updater (470) then constrains the future complexity noise measure to be within 0 and 1:

$$\gamma_{future} = \max(0, \min(1, \gamma_{future})) \tag{28},$$

where 0 indicates a reliable future complexity measure and 1 indicates an unreliable future complexity measure.

The target parameter updater (470) filters the value for $\gamma_{future}$ as part of a sequence of zero or more previously computed values for $\gamma_{future}$, producing a filtered future complexity noise measure $\gamma_{future}^{filt}$. In one implementation, the target parameter updater (470) uses a lowpass filter to smooth the values of $\gamma_{future}$ over time, which leads to smoother quality by moderating outlier values for $\gamma_{future}$ that might otherwise cause unnecessary variations in the achieved quality of the subsequent blocks.

The target parameter updater (470) can use the same filter to filter each of the control parameters, or use different filters for different control parameters. In the lowpass filter implementations, the bandwidth of the lowpass filter can be pre-determined for the encoder. Alternatively, the bandwidth can vary to control quality smoothness according to encoder settings, current buffer fullness, or another criterion. In general, wider bandwidth for the lowpass filter leads to smoother values for the control parameter, and narrower bandwidth leads to more variance in the values.

In alternative embodiments, the model parameter updater (470) updates control parameters different than or in addition to the control parameters described above, or uses different techniques to compute the control parameters, potentially using input control parameters other than or in addition to the parameters given above.

Figure 18:
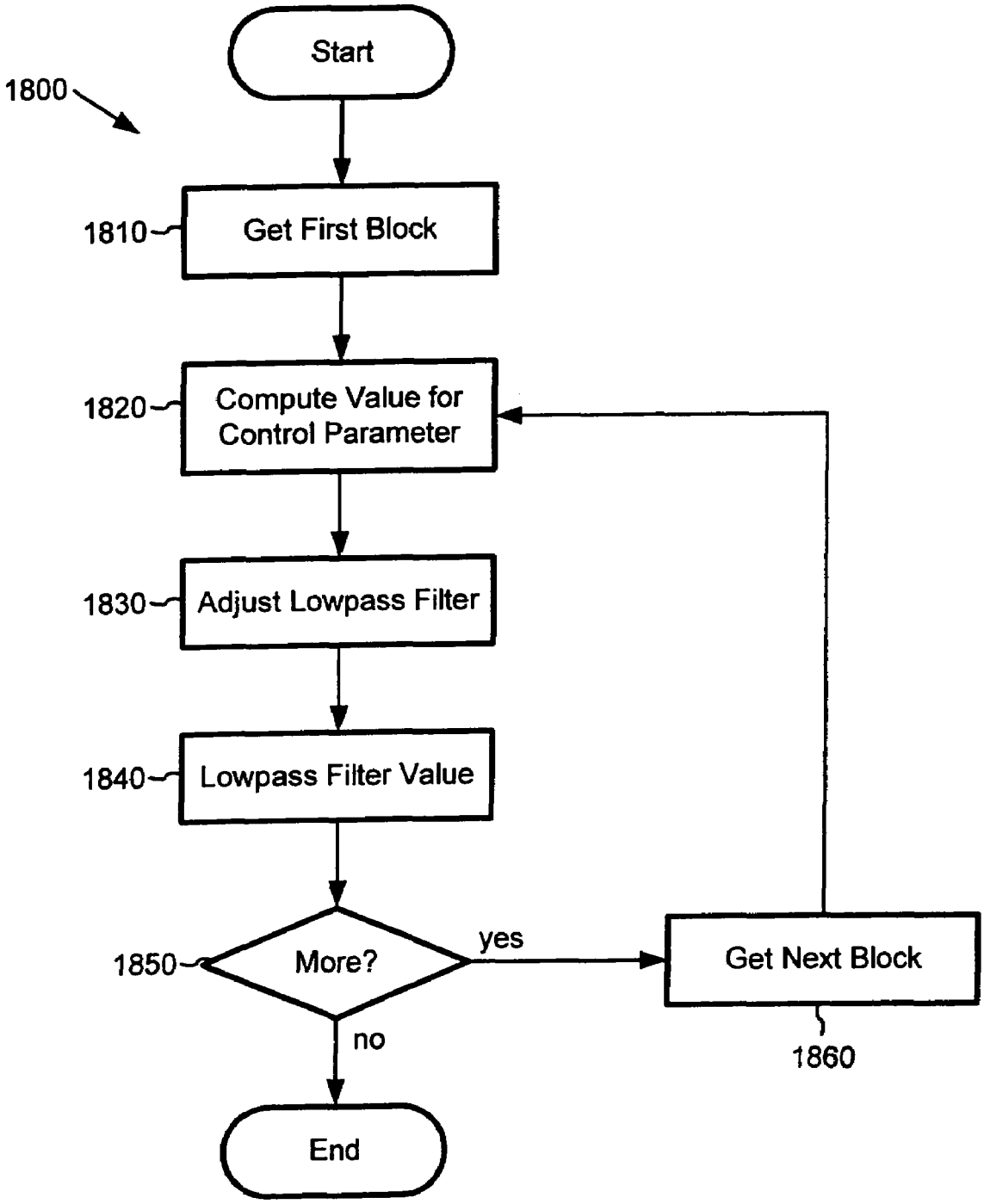
FIG. 18 is a flowchart showing a technique for lowpass filtering a value of a control parameter according to the illustrative embodiment.

FIG. 18 shows a technique (1800) for lowpass filtering values of a control parameter from block to block, in a broader context than the model parameter updater (470) of FIG. 4. A tool such as an audio encoder gets (1810) a first block and computes (1820) a value for a control parameter for the block. For example, the control parameter can be a past complexity measure, mapped relation between complexity and composite strength, past complexity noise measure, future complexity noise measure, or other control parameter.

The tool optionally adjusts (1830) the lowpass filter. For example, the tool changes the number of filter taps or amplitudes of filter taps in a finite impulse response filter, or switches to an infinite impulse response filter. By changing the bandwidth of the filter, the tool controls smoothness in the series of values of the control parameter, where wider bandwidth leads to a smoother series. The tool can adjust (1830) the lowpass filter based upon encoder settings, current buffer fullness, or another criterion. Alternatively, the lowpass filter has pre-determined settings and the tool does not adjust it.

The tool then lowpass filters (1840) the value of the control parameter, producing a lowpass filtered value. Specifically, the tool filters the value as part of a series of zero or more previously computed values for the control parameter.

If the tool determines (1850) that there are no more blocks to values of the control parameter for, the technique ends. Otherwise, the tool gets (1860) the next block and repeats the process. For the sake of simplicity, FIG. 18 does not show the various ways in which the technique (1800) can be used in conjunction with other techniques in a rate/quality controller or encoder.

Having described and illustrated Use principles of our invention with reference to an illustrative embodiment, it will be recognized that the illustrative embodiment can be modified in arrangement and detail without departing from such principles. It should be understood that the programs, processes, or methods described herein are not related or limited to any particular type of computing environment, unless indicated otherwise. Various types of general purpose or specialized environments may be used with or perform operations in accordance with the teachings described herein. Elements of the illustrative embodiment shown in software may be implemented in hardware and vice versa.

In view of the many possible embodiments to which the principles of our invention may be applied, we claim as our invention all such embodiments as may come within the scope and spirit of the following claims and equivalents thereto.

We claim:

1. In an audio encoder, a computer-implemented method comprising:

encoding audio information, wherein the encoding includes:

computing a value of a control parameter for a block of spectral coefficients for the audio information, wherein the control parameter is based at least in part upon one or more complexity estimate noise measures, and wherein each of the one or more complexity estimate noise measures affects weight given to a corresponding complexity estimate in the computing the value of the control parameter; and quantizing the block, wherein the value of the control parameter at least in part regulates the quantizing; and outputting the encoded audio information as part of an encoded audio bitstream.

2. The method of claim 1 wherein a first measure of the one or more complexity estimate noise measures indicates reliability of complexity estimation for one or more future blocks of spectral coefficients for the audio information.

3. The method of claim 1 wherein a first measure of the one or more complexity estimate noise measures indicates reliability of complexity estimation for one or more past blocks of spectral coefficients for the audio information.

4. The method of claim 1 wherein a first measure of the one or more complexity estimate noise measures indicates reliability of complexity estimation for one or more future blocks of spectral coefficients for the audio information, and wherein a second measure of the one or more complexity estimate noise measures indicates reliability of complexity estimation for one or more past blocks of spectral coefficients for the audio information.

5. The method of claim 1 wherein the control parameter is a target quality parameter.

6. The method of claim 1 further comprising:

computing the one or more complexity estimate noise measures, including computing a first measure of noise in a first complexity estimate.

7. The method of claim 6 wherein the computing the one or more complexity estimate noise measures further includes lowpass filtering the first measure as part of a sequence.

8. An audio encoder comprising:

means for computing a value of a control parameter for audio information, wherein the control parameter is based at least in part upon one or more reliability measures for complexity estimates, and wherein each of the one or more reliability measures affects weight given to a corresponding one of the complexity estimates in the computing the value of the control parameter; and a quantizer for quantizing the audio information, wherein the value of the control parameter at least in part regulates the quantizer.

9. The audio encoder of claim 8 further comprising:

means for computing the one or more reliability measures based upon noise in the complexity estimates.

10. The audio encoder of claim 8 wherein the complexity estimates include past complexity estimates, the encoder further comprising:

a past complexity estimator for computing the past complexity estimates.

11. The audio encoder of claim 8 wherein the complexity estimates include future complexity estimates, the encoder further comprising:

a future complexity estimator for computing the future complexity estimates.

12. The audio encoder of claim 8 wherein the complexity estimates include past complexity estimates and future complexity estimates, the encoder further comprising:

a past complexity estimator for computing the past complexity estimates; and a future complexity estimator for computing the future complexity estimates.

13. A computer-readable storage medium storing computer-executable instructions for causing a computer system programmed thereby to perform a method comprising:

computing a value of a control parameter for a block of spectral audio information, wherein the control parameter is based at least in part upon one or more complexity estimate noise measures, and wherein each of the one or more complexity estimate noise measures affects weight given to a corresponding complexity estimate in the computing the value of the control parameter; and quantizing the block, wherein the value of the control parameter at least in part regulates the quantizing.

14. The computer-readable storage medium of claim 13, wherein a first measure of the one or more complexity estimate noise measures indicates reliability of complexity estimation for one or more future blocks of spectral audio information.

15. The computer-readable storage medium of claim 13, wherein a first measure of the one or more complexity estimate noise measures indicates reliability of complexity estimation for one or more past blocks of spectral audio information.

16. The computer-readable storage medium of claim 13, wherein a first measure of the one or more complexity estimate noise measures indicates reliability of complexity estimation for one or more future blocks of spectral audio information, and wherein a second measure of the one or more complexity estimate noise measures indicates reliability of complexity estimation for one or more past blocks of spectral audio information.

17. The computer-readable storage medium of claim 13, wherein the control parameter is a target quality parameter.

18. The computer-readable storage medium of claim 13, wherein the method further comprises computing the one or more complexity estimate noise measures, including computing a first measure of noise in a first complexity estimate and lowpass filtering the first measure as part of a sequence.

19. In an audio encoder, a computer-implemented method comprising:

encoding audio information, wherein the encoding includes:

computing one or more complexity estimate noise measures, including computing a first measure of noise in a first complexity estimate, wherein the computing the one or more complexity estimate noise measures further includes lowpass filtering the first measure as part of a sequence;

computing a value of a control parameter for a block of spectral coefficients for the audio information, wherein the control parameter is based at least in part upon the one or more complexity estimate noise measures; and quantizing the block, wherein the value of the control parameter at least in part regulates the quantizing;

outputting the encoded audio information as part of an encoded audio bitstream.

20. The method of claim 19 wherein a first complexity estimate noise measure of the one or more complexity estimate noise measures indicates reliability of complexity estimation for one or more future blocks of spectral coefficients for the audio information.

21. The method of claim 19 wherein a first complexity estimate noise measure of the one or more complexity estimate noise measures indicates reliability of complexity estimation for one or more past blocks of spectral coefficients for the audio information.

22. The method of claim 19 wherein a first complexity estimate noise measure of the one or more complexity estimate noise measures indicates reliability of complexity estimation for one or more future blocks of spectral coefficients for the audio information, and wherein a second complexity estimate noise measure of the one or more complexity estimate noise measures indicates reliability of complexity estimation for one or more past blocks of spectral coefficients for the audio information.

23. The method of claim 19 wherein the control parameter is a target quality parameter.

24. A computer-readable storage medium storing computer-executable instructions for causing a computer system programmed thereby to perform a method comprising:

computing one or more complexity estimate noise measures, including:

computing a first measure of noise in a first complexity estimate, and lowpass filtering the first measure as part of a sequence;

computing a value of a control parameter for a block of spectral audio information, wherein the control parameter is based at least in part upon the one or more complexity estimate noise measures; and quantizing the block, wherein the value of the control parameter at least in part regulates the quantizing.

25. The computer-readable storage medium of claim 24, wherein a first complexity estimate noise measure of the one or more complexity estimate noise measures indicates reliability of complexity estimation for one or more future blocks of spectral audio information.

26. The computer-readable storage medium of claim 24, wherein a first complexity estimate noise measure of the one or more complexity estimate noise measures indicates reliability of complexity estimation for one or more past blocks of spectral audio information.

27. The computer-readable storage medium of claim 24, wherein a first complexity estimate noise measure of the one or more complexity estimate noise measures indicates reliability of complexity estimation for one or more future blocks of spectral audio information, and wherein a second complexity estimate noise measure of the one or more complexity estimate noise measures indicates reliability of complexity estimation for one or more past blocks of spectral audio information.

28. The computer-readable storage medium of claim 24, wherein the control parameter is a target quality parameter.

* * * * *